US005400599A

United States Patent [19]

Sekiya et al.

[11] Patent Number: 5,400,599

[45] Date of Patent: Mar. 28, 1995

[54] HOT GAS MACHINE

[75] Inventors: Hiroshi Sekiya, Ota; Masahisa Otake, Oizumi; Junji Matsue; Ryouichi Katohno, both of Gunma; Toshikazu Ishihara, Kumagaya; Izumi Okamoto, Ota; Yoshiaki Kurosawa; Mitsuhiko Ishino, both of Gunma, all of Japan

[73] Assignee: Sanyo Electric Co., Ltd., Osaka, Japan

[21] Appl. No.: 987,215

[22] Filed: Dec. 8, 1992

[30] Foreign Application Priority Data

| | | | |
|---|---|---|---|
| Dec. 9, 1991 | [JP] | Japan | 3-324727 |
| Dec. 10, 1991 | [JP] | Japan | 3-325775 |
| Dec. 10, 1991 | [JP] | Japan | 3-325776 |
| Dec. 10, 1991 | [JP] | Japan | 3-325777 |

[51] Int. Cl.[6] ..... F25B 9/00

[52] U.S. Cl. ..... 62/6; 60/520

[58] Field of Search ..... 62/6; 60/517, 520

[56] References Cited

U.S. PATENT DOCUMENTS

| | | | |
|---|---|---|---|
| 1,275,507 | 8/1918 | Vuilleumier | 62/6 |
| 3,188,821 | 6/1965 | Chellis | 62/6 |
| 3,296,808 | 1/1967 | Malik | 60/520 |
| 3,379,026 | 4/1968 | Cowans | 62/6 |
| 3,812,677 | 5/1974 | Greis | 60/517 |
| 4,683,723 | 8/1987 | Doi et al. | 62/6 |

FOREIGN PATENT DOCUMENTS

| | | | |
|---|---|---|---|
| 63-311050 | 12/1988 | Japan . | |
| 1150507 | 4/1969 | United Kingdom | 62/6 |

*Primary Examiner*—Henry A. Bennett
*Assistant Examiner*—William C. Doerrler
*Attorney, Agent, or Firm*—Wenderoth, Lind & Ponack

[57] ABSTRACT

Gas displacement volumes of a high temperature chamber and a middle temperature chamber in a high temperature portion of a hot gas machine are different. Alternatively, a gas displacement volume of a low temperature chamber and a middle temperature chamber in a low temperature portion are different.

10 Claims, 26 Drawing Sheets

HOT GAS MACHINE

BACKGROUND OF THE INVENTION

The present invention relates to a hot gas machine which includes low-temperature, middle-temperature and high-temperature heat sources, which causes a working medium to absorb the heat from the low-temperature heat source and from the high-temperature heat source, and which discharges the absorbed heat to the middle-temperature heat source.

One of the basic machines which comprises low-temperature, middle-temperature and high-temperature heat sources and discharges the absorbed heat to the middle-temperature heat source is a Vuilleumier (VM) cycle machine as disclosed in U.S. Pat. No. 1,275,507.

In general, a hot gas machine has two displacers for displacing a working medium, that is, a high-temperature displacer and a low-temperature displacer, and is divided into a high temperature portion and a low temperature portion with which the displacers are respectively associated. That is, in both the high temperature portion and the low temperature portion, the working medium is displaced by the operation of the displacers. The volume of a "working chamber" changes as the gas is displaced by a displacer. The high temperature portion and the low temperature portion each has two working chambers, one of which is under a temperature substantially equal to that of the middle-temperature heat source and will be hereinafter referred to as "a middle temperature chamber". Similarly, the working chamber under a temperature equal to that of the high-temperature heat source and the working chamber under a temperature equal to that of the low-temperature heat source will be referred to as "a high temperature chamber" and "a low temperature chamber", respectively.

The work associated with these working chambers, due to a change in volume and pressure of the medium occupying the working space (entire space of the machine), includes expansion of the medium in the high temperature chamber, compression of the medium in the middle temperature chamber of the high temperature portion, expansion of the medium in the low temperature chamber, and compression of the medium in the middle temperature chamber of the low temperature portion.

In the conventional hot gas Vuilleumier (VM) machine described above, heat is merely transferred from among the three heat sources and the gas displacement volumes of the high temperature portion and the low temperature portion are equal to each other. Thus, the absolute volumes of gas expanded and compressed in the high temperature portion are equal to each other, and the absolute volumes of gas expanded and compressed in the low temperature portion are equal to each other for given strokes of the displacers, respectively. In the practical machine, rods are provided to drive the displacers as shown in Japanese Patent Publication (unexamined) No. 63-311050.

The diameter of the rod connected to the high temperature displacer is different from that of the rod connected to the low temperature displacer so that total volume of the high and low temperature portions varies and only a shaft output is increased by the varied total volume and the pressure change of the working medium (gas) sealed therein.

SUMMARY OF THE INVENTION

A first object of the present invention concerns the high temperature portion, and is to provide a hot gas machine having improved cooling/heating capacities and efficiency by designing a middle temperature chamber of the high temperature portion to have a gas displacement volume greater than that of a high temperature chamber.

A second object of the present invention concerns the low temperature portion, and is to provide a hot gas machine having an improved heating capacity, shaft output at the low temperature portion, and, if necessary, cooling capacity.

A third object of the present invention concerns the high temperature portion, and is to provide a hot gas machine which can provide an improved (high) shaft output at the high temperature portion, by designing the high temperature chamber to have a gas displacement volume greater than that of the middle temperature chamber of the high temperature portion.

A fourth object of the present invention concerns the low temperature portion, and is to provide a hot gas machine having an improved (high) thermal efficiency by designing a middle temperature chamber of the low temperature portion to have a gas displacement volume greater than that of a low temperature chamber.

A fifth object of the present invention is to provide a hot gas machine having improved cooling/heating capacities, shaft output and thermal efficiency.

To achieve these objects of the present invention, there is provided a hot gas machine comprising:

a cylinder containing therein a sealed working gas, displacer means for dividing the cylinder into a high temperature chamber, a middle temperature chamber and a low temperature chamber, the displacer means including a high temperature side displacer and a low temperature side displacer, a first gas passage connecting the high temperature chamber to the middle temperature chamber, a high temperature side heat exchanger, a high temperature side regenerator and a middle temperature side first heat exchanger, disposed along a circuit formed by the high temperature chamber, middle temperature chamber and first gas passage, a second gas passage connecting the low temperature chamber to the middle temperature chamber, and a low temperature side heat exchanger, a low temperature side regenerator and a middle temperature side second heat exchanger, disposed along a circuit formed by the middle temperature chamber, the low temperature chamber and the second gas passage, wherein the middle temperature chamber has a gas displacement volume different from the gas displacement volume of either the high or low temperature chamber.

For instance, the gas displacement volume of the low temperature chamber may be greater than the gas displacement volume of the middle temperature chamber.

Alternatively, the gas displacement volume of the high temperature chamber may be greater than the gas displacement volume of the middle temperature chamber.

Of course, the gas displacement volume of the middle temperature chamber can be greater than the gas displacement volume of the low temperature chamber.

In any of these cases, a subsidiary cylinder having a subsidiary piston therein could be connected to the middle temperature chamber to produce the above-described differences in the gas displacement volumes.

A crank mechanism, commonly coupled to the high temperature side displacer and the low temperature side displacer, can also drive the subsidiary piston.

In this structure, the subsidiary piston is coupled to an eccentric shaft which is disposed on a main shaft of the crank mechanism.

The crank mechanism may have a first crank pin and a second crank pin, and the subsidiary piston may be coupled to the second crank pin.

In another embodiment, a cam is disposed on the main shaft of the crank mechanism and a rod with rollers is disposed on the subsidiary piston so that the subsidiary piston is coupled to and driven by the cam and the rod.

The hot gas machine is operated by repeating the following four strokes.

First Stroke (heat dissipation)

The gas is displaced from the low temperature chamber to the middle temperature chamber (low) through the low temperature regenerator by the low temperature side displacer.

The displaced gas receives heat from the low temperature regenerator to raise its temperature (for example, from 0° C. to 60° C.).

The gas expands in accordance with the elevation of its temperature and a part (4/5 of the displaced volume) of the gas fills the middle temperature chamber (low). Thus, remaining gas passes through a passage to compress the gas in the middle temperature chamber (high).

The gas being compressed experiences a temperature increase (from 60° C. 100 atm to 75° C. 105 atm) and this heat dissipates whereby the temperature of the gas is lowered (from 75° C. to 60°).

Second Stroke (heat dissipation)

The gas is displaced from the middle temperature chamber (high) to the high temperature chamber through the high temperature regenerator by the high temperature side displacer.

The gas passed through the high temperature regenerator receives heat from the high temperature regenerator and its temperature rises (from 60° C. to 600° C.).

The gas expands according to the elevation of its temperature and a part (2/5 of the displaced volume) of the gas fills the high temperature chamber. Thus, the remaining gas is prevented from flowing into the high temperature chamber and passes through the passage to compress the gas in the middle temperature chamber (low).

The gas being compressed experiences a temperature rise (from 60° C. 105 atm to 115° C. 125 atm) in the middle temperature chamber (low) and dissipates heat whereby the elevated temperature of the gas is lowered (from 115° C. to 60° C.).

Third Stroke (heat absorption)

The gas is displaced from the middle temperature chamber (low) to the low temperature chamber through the low temperature regenerator by the low temperature side displacer.

The displaced gas dissipates heat to the low temperature regenerator whereby the temperature of the gas is lowered (from 60° C. to 0° C.).

Thus, the volume of the displaced gas is reduced, and a part (about 1/10) of the gas in the high temperature chamber passes through the heat exchangers and the passages to the low temperature chamber to make up for the reduced volume.

Accordingly, the temperature and pressure of the gas in the high temperature chamber are lowered (from 600° C. 125 atm to 550° C. 115 atm) and the gas absorbs heat from the outside (combustor) whereby its temperature is raised (from 550° C. to 600°).

Fourth Stroke (heat absorption)

The gas is displaced from the high temperature chamber to the middle temperature chamber (high) through the high temperature regenerator by the high temperature side displacer.

The displaced gas dissipates heat to the high temperature regenerator and its temperature is lowered (from 600° C. to 60° C).

Thus, the volume of the displaced gas is reduced, and a part (about 1/5) of the gas in the low temperature chamber passes through the heat exchangers and the passages to the middle temperature chamber (high) to make up for the reduced volume.

Accordingly, the temperature and pressure of the gas in the low temperature chamber are lowered (from 0° C. 115 atm to −35° C. 100 atm), and the gas absorbs heat from the outside (cooling medium) whereby its temperature rises (from −35° C. to 0° C.).

In the third stroke described above, heat (thermal energy) is supplied from the high temperature heat source. In the fourth stroke, the heat is absorbed from the low temperature heat source so that the low temperature heat source can be used in a cooling operation. Further, in the first and second strokes, the heat is dissipated to the middle temperature heat source so that the middle temperature heat source is available for use in a heating operation.

DETAILED DESCRIPTION OF THE PREFERRED EMBODIMENTS

First Embodiment

Figure 1:
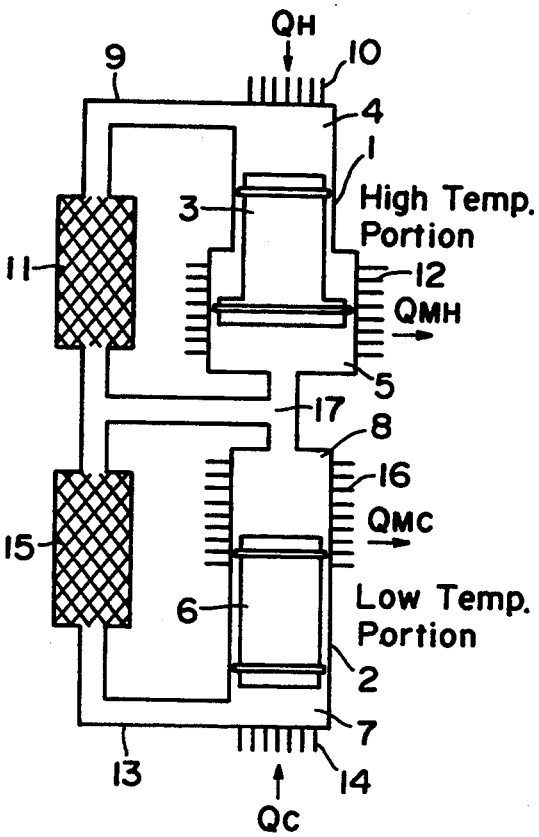
FIG. 1 is a schematic diagram of a first embodiment of a hot gas machine according to the present invention.

Referring first to FIG. 1, a hot gas machine according to the present invention has a high temperature side cylinder 1, a low temperature side cylinder 2, both of which contain a working medium (gas) such as helium gas and hydrogen gas sealed therein, a high temperature side displacer 3 which partitions an interior of the high temperature side cylinder 1 into a high temperature chamber 4 and a high temperature side middle temperature chamber 5, and a low temperature side displacer 6 which partitions an interior of the low temperature side cylinder 2 into a low temperature chamber 7 and a low temperature side middle temperature chamber 8.

The high temperature chamber 4 is connected to the high temperature side middle temperature chamber 5 by means of a high temperature side gas passage 9. The high temperature portion is also provided with a high temperature side heat exchanger 10, a high temperature side regenerator 11 and a middle temperature side heat exchanger 12.

The low temperature chamber 7 is connected to the low temperature side middle temperature chamber 8 by means of a low temperature side gas passage 13. The low temperature portion is also provided with a low temperature side heat exchanger 14, a low temperature regenerator 15 and a middle temperature side heat exchanger 16.

The middle temperature chamber 5 of the high temperature portion is connected to the middle temperature chamber 8 of the low temperature portion by means of a passage 17.

A gas displacement volume of the high temperature side middle temperature chamber 5 is larger than the gas displacement volume of the high temperature chamber 4. FIG. 1 shows the middle temperature chamber 5 as including an incremental volume (the incrementing means being the larger diameter portions of the inner wall defining chamber 5 and head disposed in chamber 5 and integral with displacer 3). This incremental volume need not vary equally to changes in the volume of the middle temperature chamber 5; rather, a suitable mechanism independent of chamber 5 can provide an incremental volume, that is a space to be occupied by gas.

Figure 7:
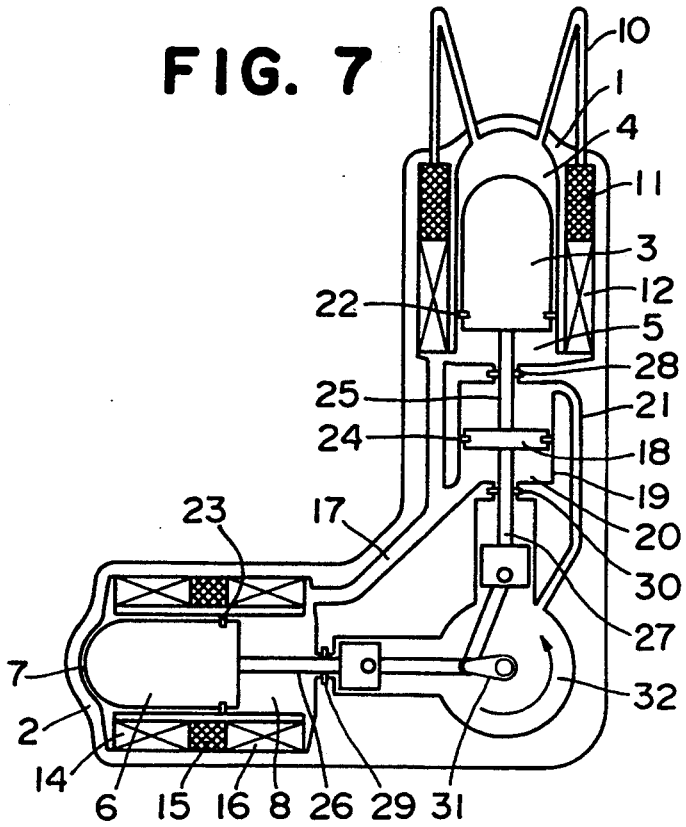
FIG. 7 is a longitudinal elevation view of a first embodiment of the hot gas machine according to the invention, showing a preferred structure thereof.

In a preferred embodiment, the two displacers 3, 6 are out of phase by 90° (as shown in FIG. 7) which phase difference, however, can be selected as desired. Inner diameters of the cylinders 1 and 2 can be made equal to or different from each other.

The hot gas machine has three heat sources (high, middle and low temperature heat sources) and heat is transferred from these three heat sources. The heat is transferred by two thermal effects (hereinafter referred to as a primary thermal effect and a secondary thermal effect). If the high temperature portion of the hot gas machine is considered to include the high temperature chamber 4, the middle temperature chamber 5 and the regenerator 11, and the low temperature portion is considered to include the low temperature chamber 7, the middle temperature chamber 8 and the regenerator 15, there is a thermal effect when the temperature of the working gas changes to the temperature of the heat source as the gas is displaced by the displacers 3, 6. This thermal effect is referred to as the primary thermal effect, that is, an effect produced by operation of the regenerators 11, 15. At the moment when the displacers 3, 6 are stopped due to the phase difference between the two displacers, there is not an apparent displacement of gas from the working chambers, and a heat exchanger between the working gas and the heat source is referred to as the secondary thermal effect.

Accordingly, the primary thermal effect in the high temperature portion is created during the secondary thermal effect in the low temperature portion, while the primary thermal effect in the low temperature portion is created during the secondary thermal effect in the high temperature portion. The phrase "gas displacement volume" referred to throughout the present specification refers to the volume of a working gas which is involved in the primary thermal effect during each stroke of operation, and thereby refers to a characteristic of a chamber indicative of the volume of working gas which has the same temperature as each of the heat sources and is displaced during the stroke of a displacer through the chamber.

Practically speaking, however, the motion of the displacers 3, 6 (and of a piston which will be necessary when a subsidiary cylinder is provided) will be substantially in the form of a sinewave. Therefore, the actual displacement and standstill thereof do not occur as theoretically as described above in connection with the primary and secondary thermal effects.

However, based upon the operation of the displacers 3, 6 and a piston which will be described shortly, it is possible to discriminate the degree to which the volume of gas is involved in the primary heat effect during a particular stroke.

Figure 2:
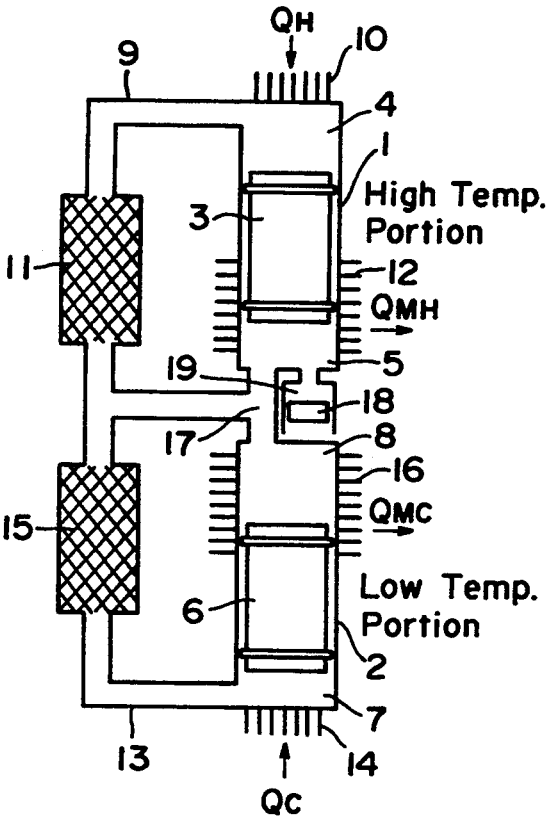
FIG. 2 is another schematic diagram of a first embodiment of a hot gas machine according to the present invention.

In order to provide the high temperature side middle temperature chamber 5 with a gas displacement volume large than that of the high temperature chamber 4, a suitable mechanism for incrementing the volume of the middle temperature chamber can be added as shown in FIG. 2. As illustrated, a subsidiary cylinder 19 having a piston 18 is provided in open communication with the high temperature side middle temperature chamber 5. The volume of cylinder 19, and the phase of the piston 18 can be designed for as desired.

The subsidiary cylinder 19, which is connected to the middle temperature chamber 5 of the high temperature portion in the embodiment shown in FIG. 2, can instead open into the low temperature side middle temperature chamber 8 which is connected to the middle temperature chamber 5.

Figure 3:
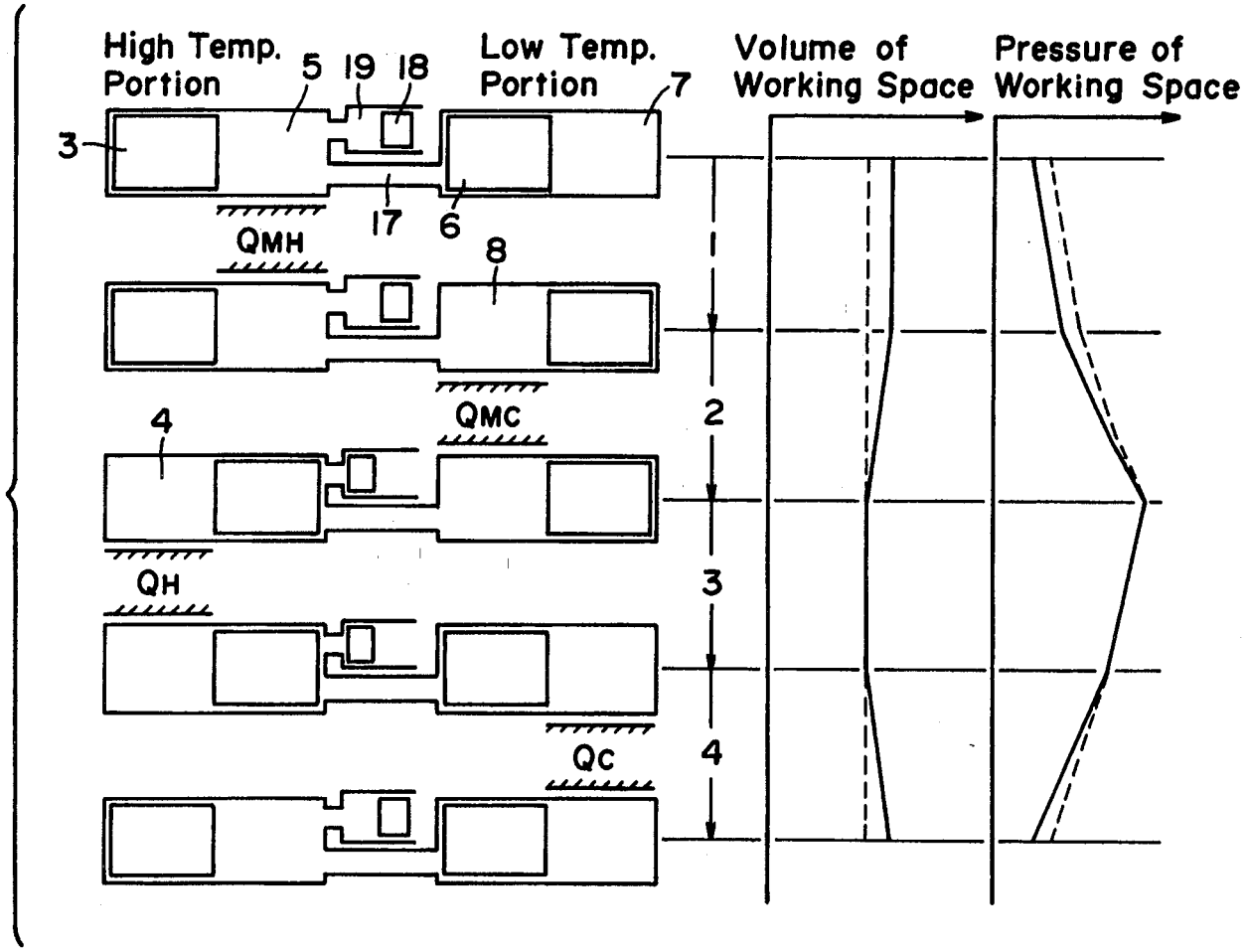
FIG. 3 is an operational diagram of the hot gas machine, showing strokes during the operation, FIGS. 4(*a*) and 4(*b*) are graphs showing the performance of the hot gas machine according to the invention.

Operational strokes of the displacers 3 and 6 and the piston 18 in the embodiment of FIG. 2 are shown in FIG. 3 which also shows a pressure variation in the hot gas machine. In FIG. 3, the working gas in the low temperature chamber 7 is displaced into the low temperature side middle temperature chamber 8 by a displacement (first stroke) of the low temperature side displacer 6, so that the pressure in the working space rises as shown by a solid line.

In FIG. 3, the phantom line shows the pressure in the working space of the conventional hot gas machine which does not have an incrementing means such as the subsidiary cylinder 19. The reason why the pressure shown by the solid line is lower than the pressure shown by the phantom line is that the piston 18 remains positioned at one end of the cylinder 19 during the first stroke (the right end in FIG. 3) so that the volume of the middle temperature chamber 5 is, in effect, incremented by the volume of the subsidiary cylinder 19.

In this state, the temperature of the gas in the middle temperature chamber 5 rises to a temperature different from that of the heat source. Consequently, a quantity of heat $Q_{MH}$ dissipates from the middle temperature side heat exchanger 12 of the high temperature portion.

By a displacement (second stroke) of the displacer 3, the gas is displaced from the high temperature side middle temperature chamber 5 to the high temperature chamber 4, so that the pressure in the working space rises as shown by the solid line. The reason why the pressure increase shown by the solid line is larger than that shown by the phantom line is that the piston 18 moves to the other end (left end in FIG. 3) so that the volume of the working gas in the subsidiary cylinder 19 is decreased to zero. At this moment, the temperature of the gas in the low temperature side middle temperature chamber 8 rises, and a quantity of heat $Q_{MC}$ which is dissipating from the middle temperature side heat exchanger 16 of the low temperature portion increases in accordance with the increase in pressure. Thus, a high capacity and efficient heating is obtained by using, as a heat source, a medium heated by the middle temperature side heat exchanger 16 of the low temperature portion and a medium heated by the middle temperature side heat exchanger 12 of the high temperature portion.

By a further displacement (third stroke) of the low temperature side displacer 6, the working gas is displaced from the low temperature side middle temperature chamber 8 to the low temperature chamber 7, so that the pressure in the working space decreases as shown by the solid line. The reason why the pressure decreases as shown by the solid lines is that the piston 18 is maintained at the end of the cylinder 19 so that the volume of the gas in the subsidiary cylinder 19 remains at zero. In this state, the temperature of gas in the high temperature chamber 4 decreases and absorbs a quantity of heat $Q_H$ from the high temperature side heat exchanger 10.

By another displacement (fourth stroke) of the high temperature side displacer 3, the working gas in the high temperature chamber 4 is displaced to the middle temperature chamber 5, so that the pressure in the working space decreases as shown by the solid line. The reason why the decrease in pressure shown by the solid line is larger than that shown by the phantom line is that the piston 18 is moved to the other end of cylinder 19 so that the gas entering the high temperature side middle temperature chamber 5 is decreased by a volume corresponding to the volume of gas entering the subsidiary cylinder 19. At this moment, the temperature of gas in the low temperature chamber 7 is lowered, and a quantity of heat $Q_C$ which is absorbed by the low temperature side heat exchanger 14 is increased with the decrease in the pressure. Thus, a medium cooled by the low temperature side heat exchanger 14 is used for a cooling operation to thereby provide a high cooling capacity.

Although the quantity of the absorbed heat $Q_C$ and the quantity of dissipated heat $Q_{MC}$ are increased during operation, the quantity of heat $Q_H$ absorbed by the high temperature side heat exchanger 10 is substantially constant notwithstanding an increase in the volume of gas in the high temperature side middle temperature chamber 5. Thus, performance is improved.

Figure 4A:
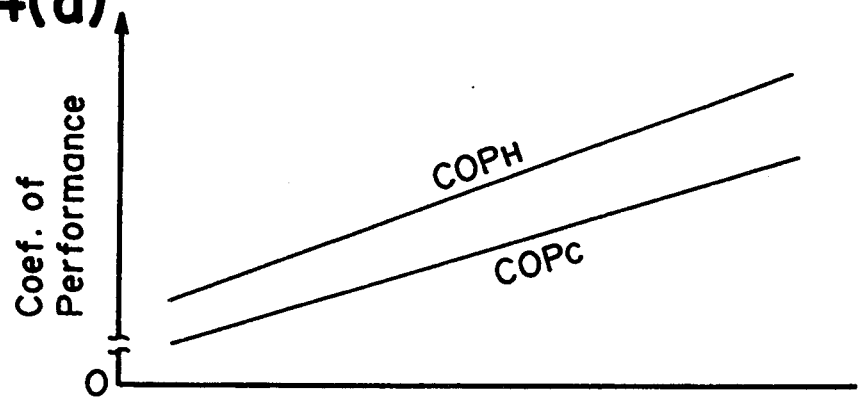
Figure 4B:
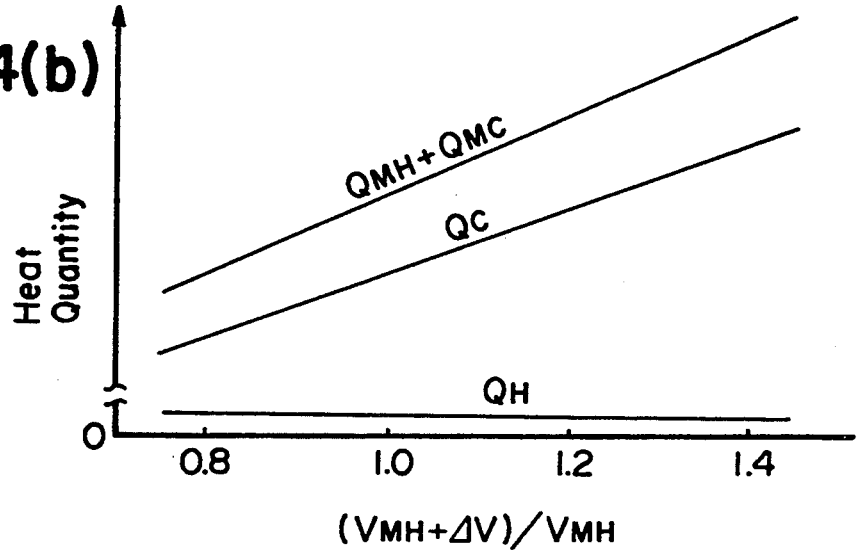

FIGS. 4(*a*) and 4(*b*) show machine performance which is obtained by using a formula postulated under the provision that the temperature of gas is constant during every stroke of the cycle and the volume of each working chamber changes in the form of a sinewave. As illustrated, both the heat $Q_C$ absorbed at the low temperature heat exchanger 14 and the heat dissipated $Q_{MC}$ at the middle temperature side heat exchanger 16 of the low temperature portion increase, and a coefficient of cooling performance $COP_C(Q_C/Q_H)$ and a coefficient of heating performance $COP_H[(Q_{MH}+Q_{MC})/Q_H]$ are largest when the inequality $(V_{MH}+\Delta V)/V_{MH}>1$ is satisfied, wherein:

$V_{MH}$: volume of the high temperature side middle temperature chamber, $\Delta V$: incremental volume created by the subsidiary cylinder 19.

Figure 5:
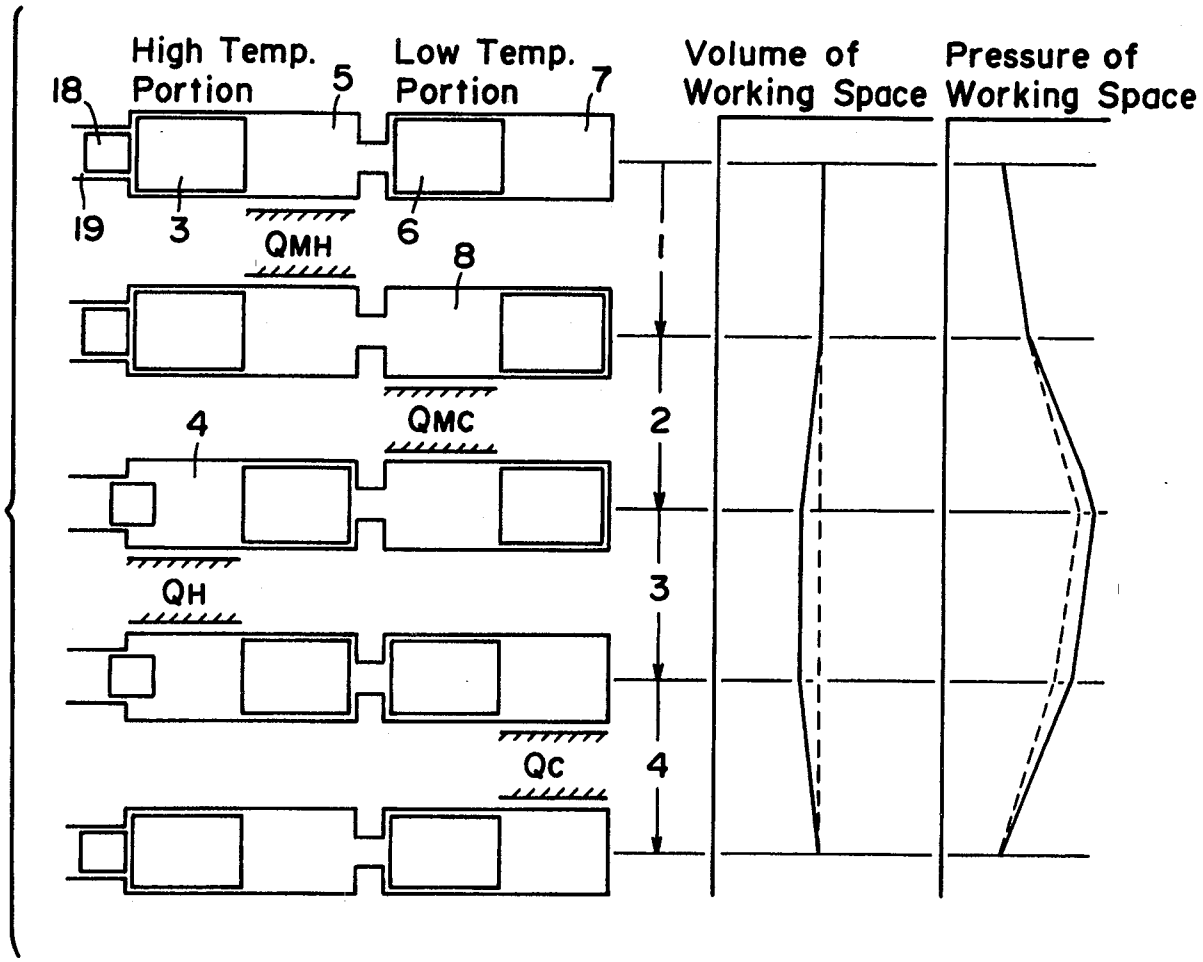
FIG. 5 is an operational diagram of a modified form of the first embodiment, FIGS. 6(*a*) and 6(*b*) are graphs of the performance of the modified form shown in FIG. 5.

FIG. 5 shows a modification in which the subsidiary cylinder 19 with the piston 18 is open to the high temperature chamber 4 to reduce, in this case, the gas displacement volume of the high temperature chamber 4, so that the gas displacement volume of the high temperature side middle temperature chamber 5 is set to be larger than the gas displacement volume of the high temperature chamber 4. In this modification, the pressure in the working space rises to a level shown by the solid line during a displacement (second stroke) of the high temperature side displacer 3, so that the quantity of heat $Q_{MC}$ which is dissipated from the middle temperature side heat exchanger 16 of the low temperature portion is increased. Thus, a high heating capacity can be realized by the use of a medium which is heated by the middle temperature side heat exchanger of the low temperature portion and a medium which is heated by the middle temperature side heat exchanger 12 of the high temperature portion.

By next displacing (fourth stroke) the high temperature side displacer 3, the pressure in the working space is lowered to the level shown by the solid line, so that the quantity of heat $Q_C$ which is absorbed by the low temperature side heat exchanger 14 increases. Thus, a high cooling capacity can be obtained by cooling the medium with the heat exchanger 14.

Figure 6A:
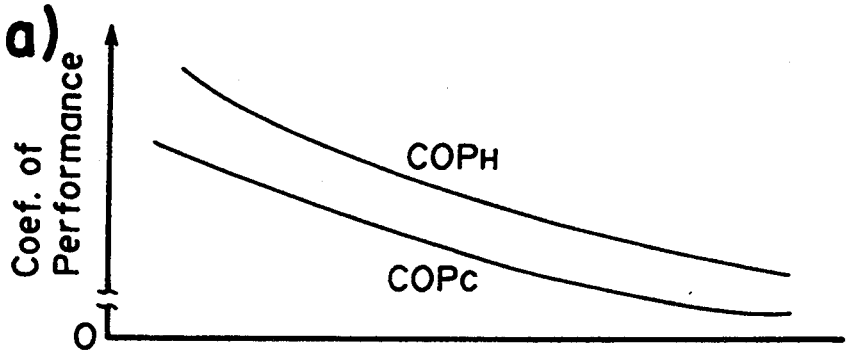
Figure 6B:
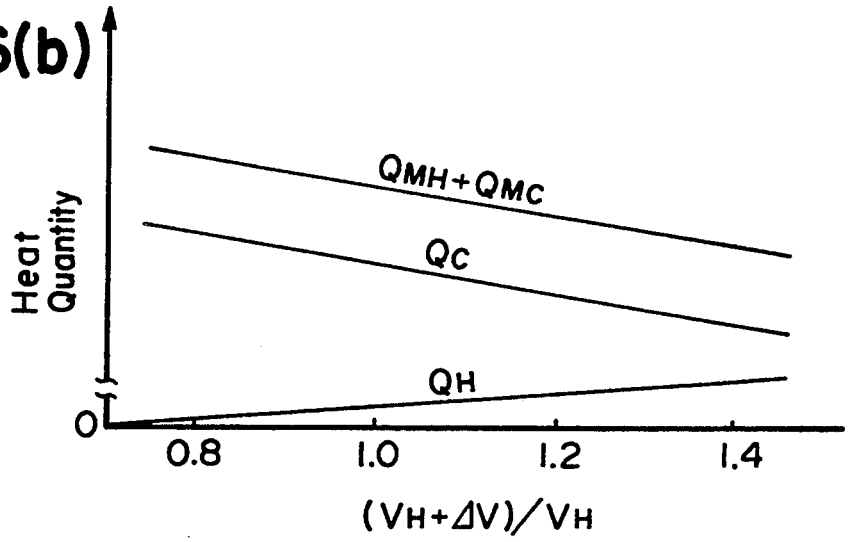

FIGS. 6(*a*) and 6(*b*), similar to FIGS. 4(*a*) and 4(*b*) show that coefficients of performance $COP_C$, $COP_H$ are largest when the inequality $(V_H+\Delta V)/V_H<1$ is satisfied, wherein $V_H$ is the volume of the high temperature chamber 4.

With reference to FIG. 7, which shows a more detailed structure of the hot gas machine according to the present invention, a subsidiary cylinder 19 and a subsidiary piston 18 having a common piston rod 25 are disposed below a middle temperature chamber 5 of the a high temperature side cylinder 1 to provide a subsidiary working chamber 20 below the subsidiary piston 18. The chamber 20, which is under the same conditions as the middle temperature chamber 5 of the high temperature side, is used for increasing a change in the volume of gas in the middle temperature chamber 5. Diameters of these elements 18, 19 20 and of a subsidiary piston rod 27 are suitably determined. A space above the subsidiary piston 18 is connected to a crank chamber 32 or is open to the outside of the machine to prevent unfavorable effects on a cyclical operation of the machine. As illustrated, the machine has a passage 21 connected to the crank chamber 32, piston seals 22, 23, a subsidiary piston seal 24, piston rods 25, 26, rod seals 28, 29, a subsidiary rod seal 30, and a crank mechanism 31. Other structural features will be apparent from FIG. 7 and the previous description made with reference to FIGS. 1 through 6.

Figure 8:
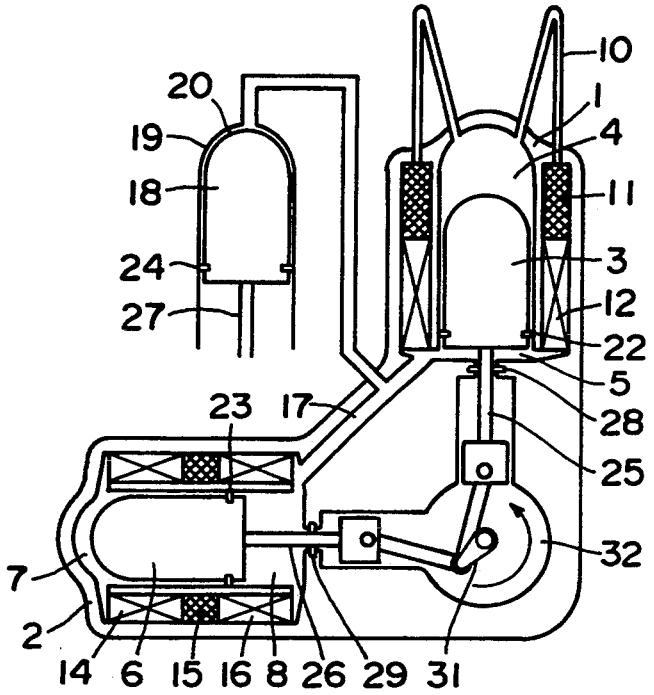
FIG. 8 is a view similar to FIG. 7 showing another preferred structure of the first embodiment of the hot gas machine according to the invention.

In FIG. 8 showing a modification of the structure of FIG. 7, a subsidiary cylinder 19 and a subsidiary piston 18 are provided independently of the cylinders 1 and 2. An inner diameter of the subsidiary cylinder 19 and an outer diameter of the subsidiary piston 18 are determined suitably, and a phase difference of the pistons is determined so that a change in the volume of gas in the high temperature side middle temperature chamber 5 is increased by the piston 18.

Figure 9:
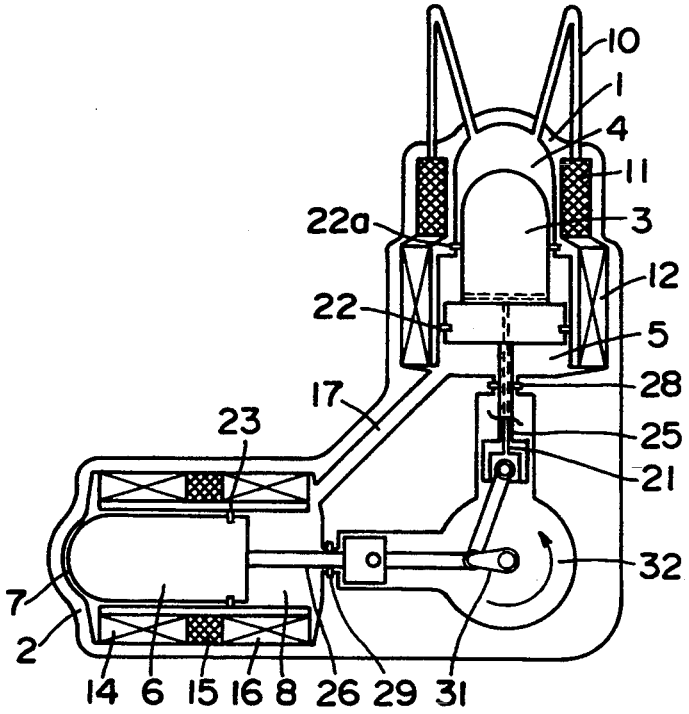
FIG. 9 is a view similar to FIG. 7 showing a further preferred structure of the first embodiment of the hot gas machine according to the invention.

In a further modification shown in FIG. 9, a middle temperature chamber 5 in a high temperature cylinder 1 is made larger than a high temperature chamber 4. In this structure, a piston seal 22*a* is provided between the displacer 3 and the side wall of the high temperature chamber 4, and a space formed between the seals 22 and 22*a* is either connected to the crank chamber 32 or is open to the outside of the machine (atmosphere). In this modification, it is possible not only to in effect increase the volume of gas in the high temperature side middle temperature chamber 5 but also to reduce the volume of gas in the high temperature chamber 4.

According to the first embodiment of the invention which has been described with reference to FIGS. 1–9, the gas displacement volume of the middle temperature chamber, which is under a temperature set by the middle temperature heat source, is larger than the gas displacement volume of the high temperature chamber, which is under a temperature set by the high temperature heat source. Accordingly, the quantity of absorbed heat is increased by decreasing the gas pressure during the stroke in which heat is absorbed from the low temperature heat source. Therefore, the machine has a high cooling capacity. Further, because the quantity of dissipated heat is increased by increasing the gas pressure during the stroke in which heat is dissipated to the middle temperature heat source, the heating capacity of the machine is also high.

Moreover, the quantity of heat absorbed from the high temperature heat source is constant notwithstanding an increase of the volume of gas in the middle temperature chamber, while both the quantities of heat absorbed and heat dissipated are increased.

Second Embodiment

Figure 10:
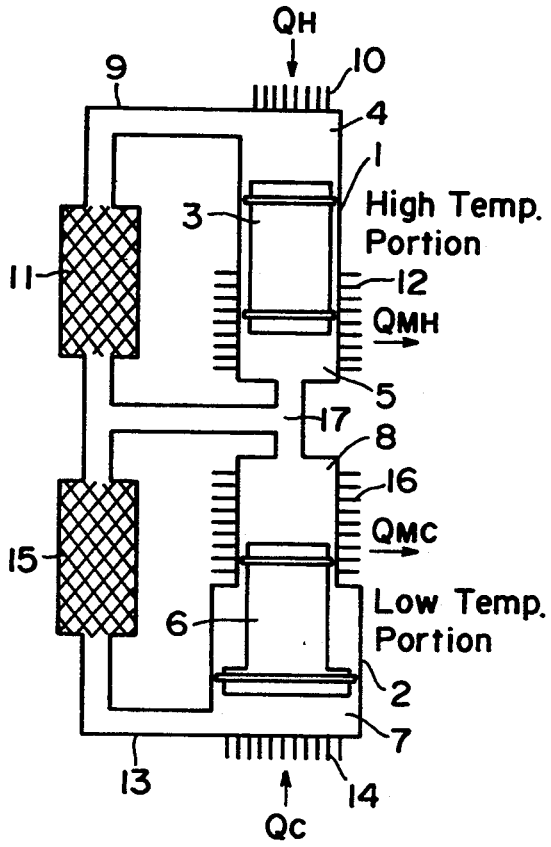
FIG. 10 is a schematic diagram of a second embodiment of a hot gas machine according to the present invention.

Referring to FIG. 10 showing a second embodiment of the invention, a gas displacement volume of a low temperature chamber 7 is larger than that of a low temperature side middle temperature chamber 8. FIG. 10 shows that an incremental volume (incrementing means) is already included in the low temperature chamber 7. It is not necessary that the incremental volume vary equally with changes in the other portion of the low temperature chamber 7. If necessary, a suitable mechanism independent of chamber 7 may provide an incremental volume.

Other structural and operational features will be understood from the description of the first embodiment.

Figure 11:
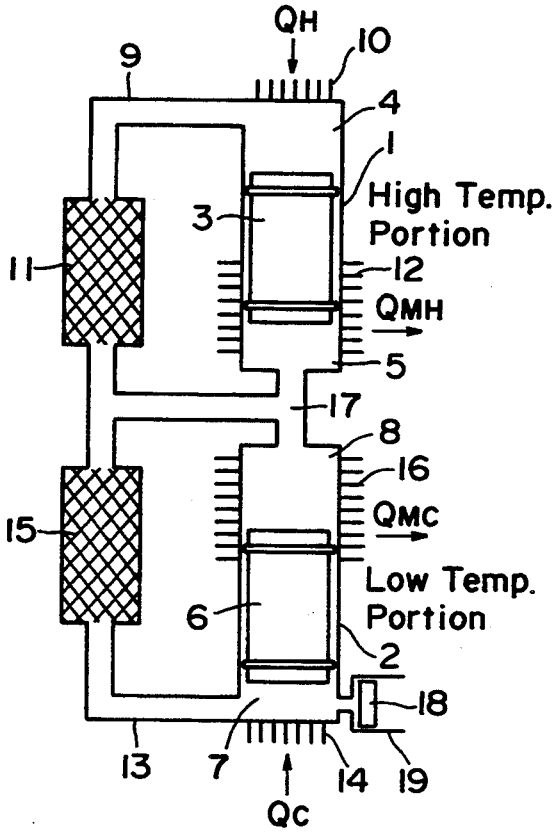
FIG. 11 is another schematic diagram of a second embodiment of a hot gas machine according to the invention.

FIG. 11 shows a modification of the embodiment of FIG. 10, in which a subsidiary cylinder 19 with a piston 18 is connected to the high temperature side low temperature chamber 7 so that the gas displacement volume of the low temperature portion is larger than the gas displacement volume of the low temperature side middle temperature chamber 8.

Figure 12:
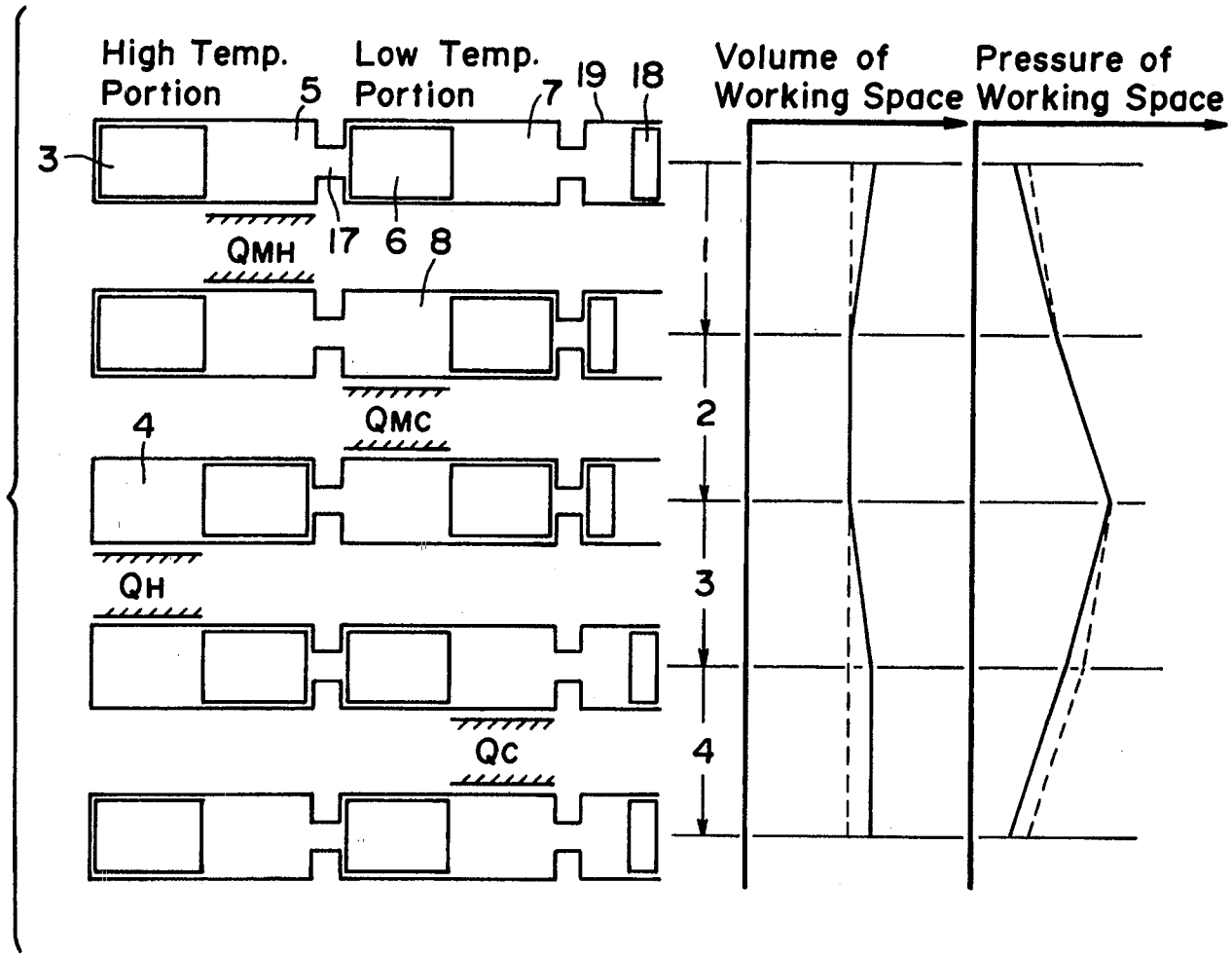
FIG. 12 is an operational diagram of the second embodiment of the hot gas machine, showing strokes during the operation, FIGS. 13(*a*) and 13(*b*) are graphs of the performance of the second embodiment of the hot gas machine according to the present invention.

Operational strokes of the displacers 3, 6 and the piston 18 in the embodiment of FIG. 11 are shown in FIG. 12 which also shows a pressure variation in the hot gas machine. In FIG. 12, the working gas in the low temperature chamber 7 is displaced into the middle temperature chamber 8 by a displacement (first stroke) of the low temperature side displacer 6, so that the pressure in the working space rises as shown by the solid line. In FIG. 12, the phantom line shows the pressure in the working space of the conventional hot gas machine which does not have an incrementing means such as the subsidiary cylinder 19. The reason why the pressure shown by the solid line is lower than the pressure shown by the phantom line is that the piston 18 is retracted (positioned at its rightward end in FIG. 12) at the start of the first stroke, so that the volume of the low temperature chamber 7 is, in effect incremented, by the volume of the subsidiary cylinder 19.

In this state, the temperature of the gas in the middle temperature chamber 5 rises to a temperature different from that of the heat source. Consequently, a quantity of heat $Q_{MH}$ dissipates from the middle temperature side heat exchanger 12 at a rate which increases with the pressure increase.

By a displacement (second stroke) of the displacer 3, the gas is moved from the middle temperature chamber 5 to the high temperature chamber 4, so that the pressure in the working space rises as shown by the solid line. The reason why the pressure rises is that the piston 18 is maintained at its extended position (leftward end) so that the volume of the gas in the subsidiary cylinder 19 remains at zero. As a result, a quantity of heat $Q_{MC}$ dissipates from the middle temperature side heat exchanger 16 of the low temperature portion, and medium heated at this moment and medium heated by the dissipated heat $Q_{MC}$ are used as a heat source in a heating operation. It can thus be seen that the machine has a large heating capacity.

By a further displacement (third stroke) of the low temperature side displacer 6, the working gas is displaced from the low temperature side middle temperature chamber 8 to the low temperature chamber 7, so that a pressure in the working space decreases as shown by the solid line. The reason why the decrease in pressure shown by the solid line is larger than that shown by the phantom line is that the piston 18 is moved to the other end of the cylinder so that the gas entering the low temperature chamber 7 is increased by a volume corresponding to the volume of gas displaced from the subsidiary cylinder 19. At this moment, the temperature of gas in the high temperature chamber 4 is lowered, and a quantity of heat $Q_H$ which is absorbed by the high temperature side heat exchanger 10 increases in correspondence with the decrease in the pressure.

By another displacement (fourth stroke) of the displacer 3, the working gas in the high temperature chamber 4 is moved to the middle temperature chamber 5, and the pressure is reduced as shown by the solid line, so that a quantity of heat $Q_C$ is absorbed by the low temperature side heat exchanger 14. A medium cooled by this heat exchanger 14 can be used in a cooling operation.

As described above, the gas displacement volume of the low temperature portion is larger than that of the middle temperature chamber 8. This results in improvements in heating capacity and shaft output.

Figure 13A:
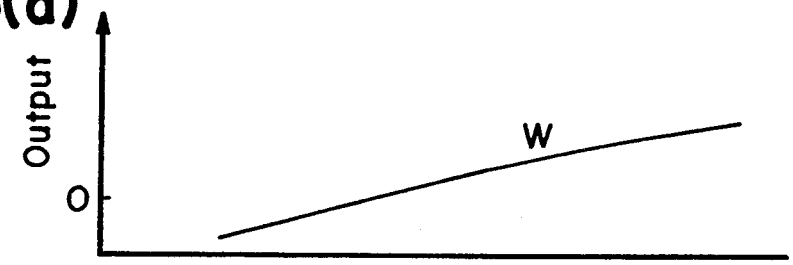
Figure 13B:
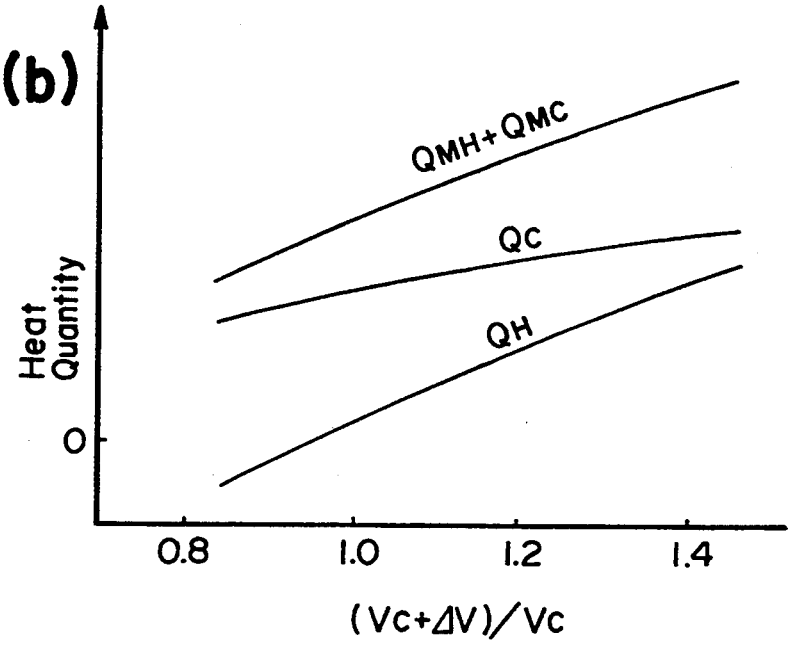

FIGS. 13(*a*) and 13(*b*), similar to FIGS. 4(*a*) and 4(*b*), show that machine performance is highest when the incremental volume $\Delta V$ provided by the subsidiary cylinder 19 falls in a range satisfying the inequality of $(V_C+\Delta V)/V_C>1$, wherein $V_C$ is the volume of the low temperature chamber 7. These diagrams illustrate the aforementioned improvement in heating capacity and shaft output W. Furthermore, some improvement in cooling capacity can also be expected.

Figure 14:
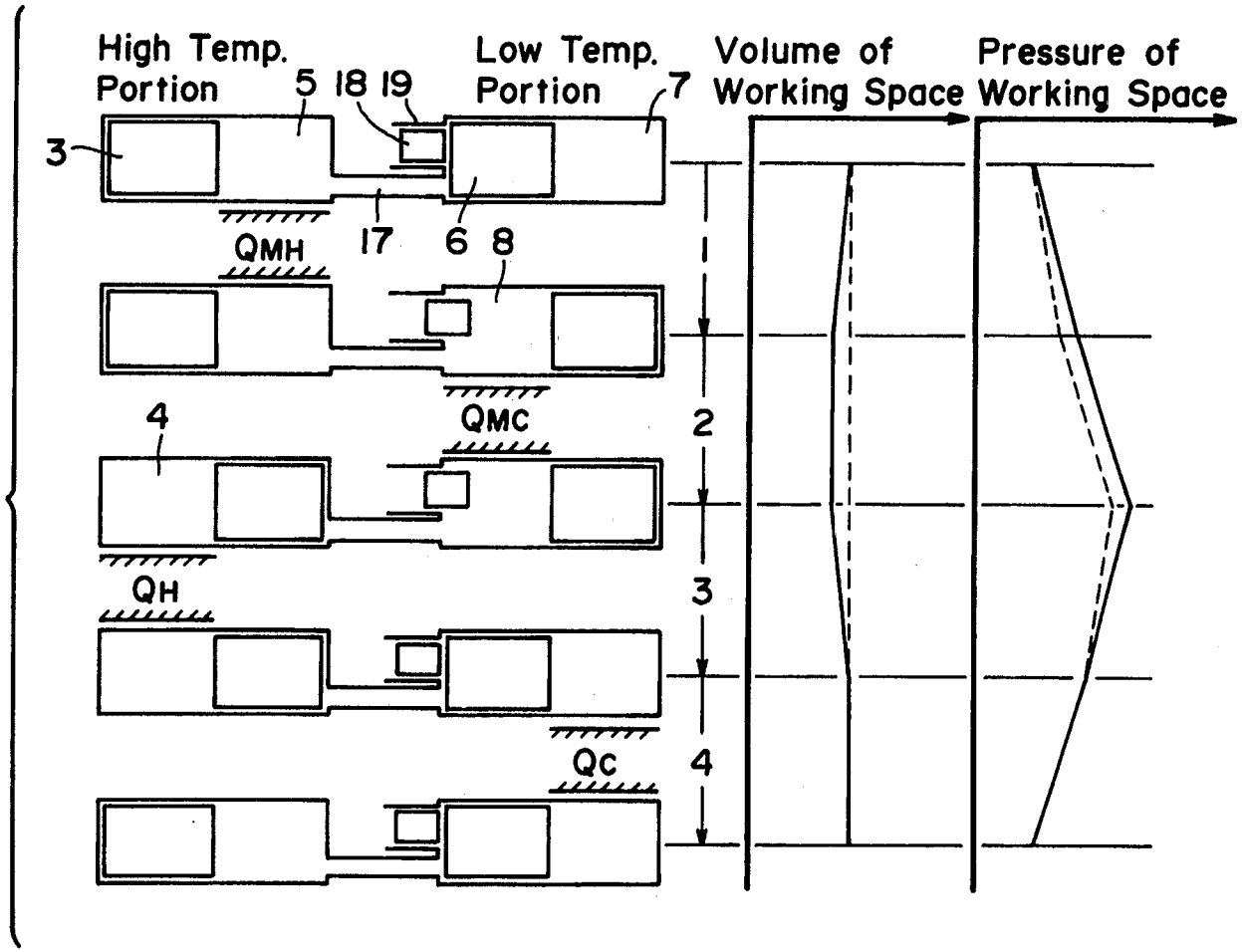
FIG. 14 is an operational diagram of a modification of the second embodiment.

FIG. 14 shows a modification in which a subsidiary cylinder 19 having a piston 18 is connected to a low temperature side middle temperature chamber 8 to reduce, in this modification, the volume of gas in the middle temperature chamber 8, so that the gas displacement volume of the low temperature chamber 7 is larger than that of the middle temperature portion. In this modification, pressure in the working space is increased as shown by the solid line by a displacement (first stroke) of the displacer 6, and the quantity of heat $Q_{MH}$ dissipated from the middle temperature side heat exchanger 12 is increased. A medium heated by this heat exchanger 12 and a medium heated by the other heat exchanger 16 can be used as a heat source whereby the machine has a large heating capacity.

In addition, by a displacement (third stroke) of the displacer 6, the pressure decreases as shown by the solid line, and the quantity of heat $Q_H$ absorbed by the high temperature side heat exchanger 10 is increased. As a result of the heat cycle described, the shaft output can be increased.

Figure 15A:
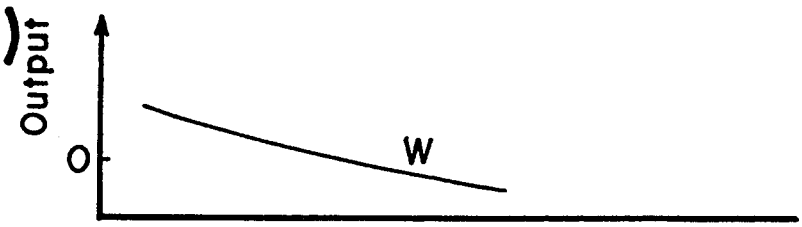
FIG. 15 is a graph of the performance of the modification shown in FIG. 14.
Figure 15B:
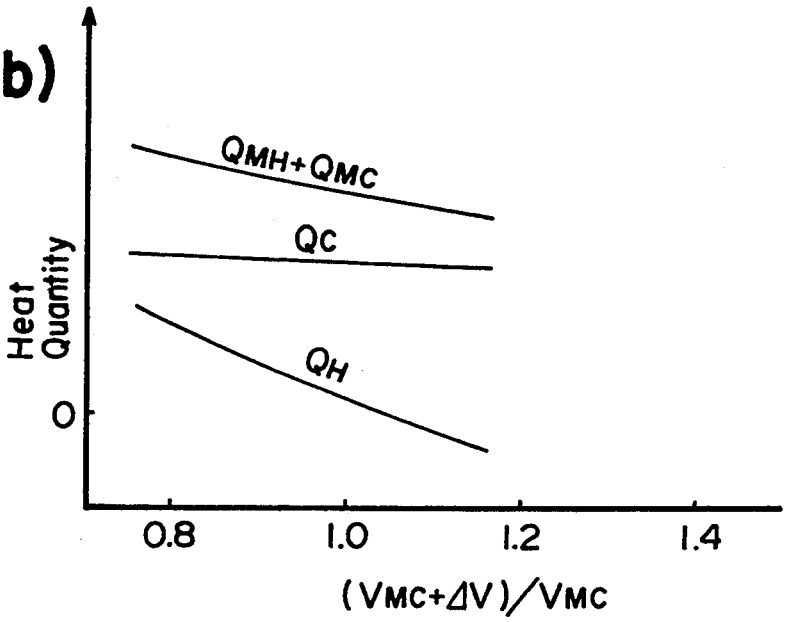

FIGS. 15(*a*) and 15(*b*) show, similar to FIGS. 13(*a*) and 13(*b*), show that machine performance is highest when the inequality $(V_{MC}+\Delta V)/V_{MC}<1$ (wherein $V_{MC}$ represents the volume of the low temperature side middle temperature chamber 8 and $\Delta V$ represent the incremental volume of the cylinder 19) is satisfied. In this case, the heating capacity can be increased and a high shaft output W can be obtained with larger incremental volumes $\Delta V$ of the subsidiary cylinder 19.

Figure 16:
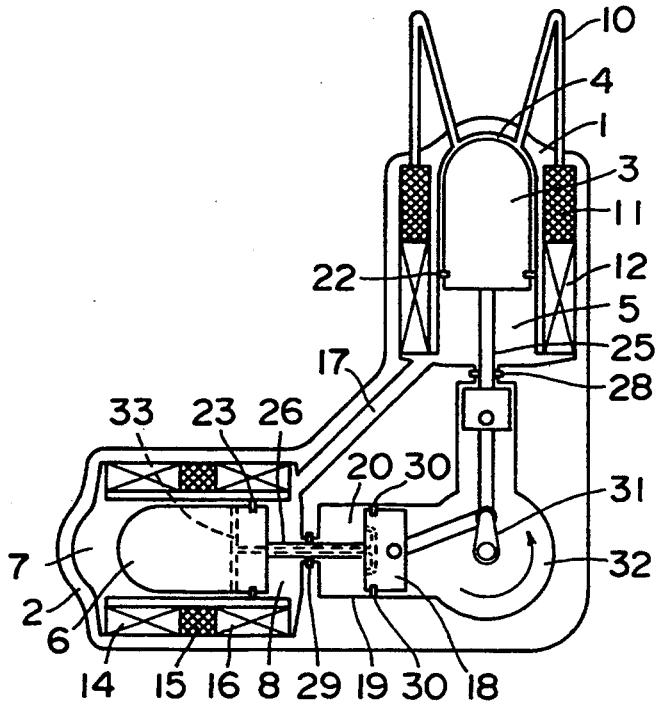
FIG. 16 is a longitudinal elevation view of the second embodiment of the hot gas machine according to the invention.

In FIG. 16 showing a detailed structure of the second embodiment of the invention, the same reference numerals are used to represent like elements shown in FIG. 7. In this structure, a subsidiary cylinder 19 and a subsidiary piston 18 having a common piston rod 26 are provided between a middle temperature chamber 8 of a low temperature side cylinder 2 and a crank chamber 32. In the embodiment of FIG. 16, the subsidiary piston 18 also serves as a crosshead guide. A subsidiary working chamber 20 which is formed above the piston 18, and is under the same conditions as the low temperature chamber 7, is used to change the volume of gas in the low temperature chamber 7. The low temperature chamber 7 is connected to the subsidiary chamber 20 through a passage 33. Other structural and operational features will be understood from the foregoing description.

Figure 17:
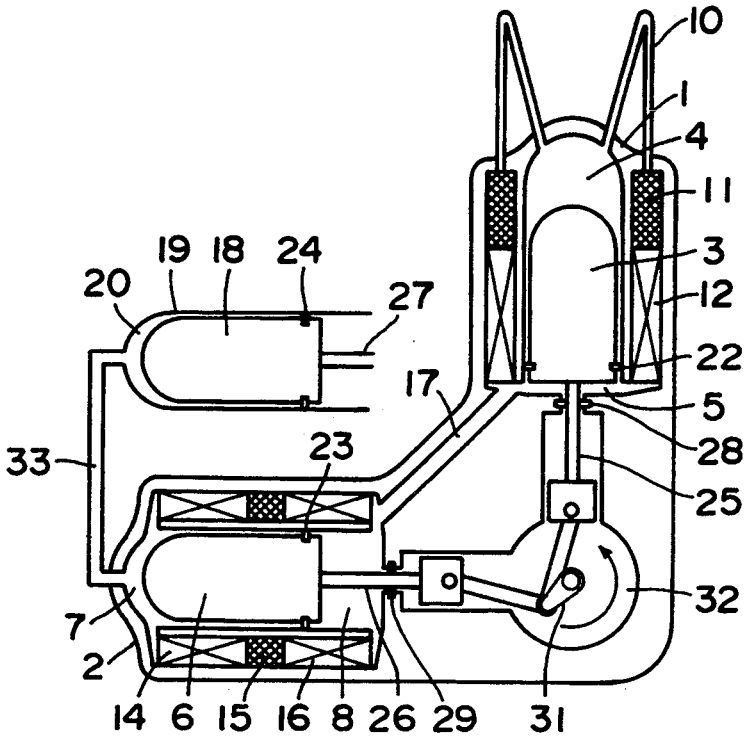
FIG. 17 is a view similar to FIG. 16, showing another preferred structure of the second embodiment of the hot gas machine according to the invention.

In another modification shown in FIG. 17, a subsidiary cylinder 19 and its piston 18 are provided independently of the crank mechanism 32. A phase difference of the pistons 6, 18 is established so that the effective volume of the low temperature chamber 7 can be increased. Other structural and operational features will be understood from the foregoing description.

Figure 18:
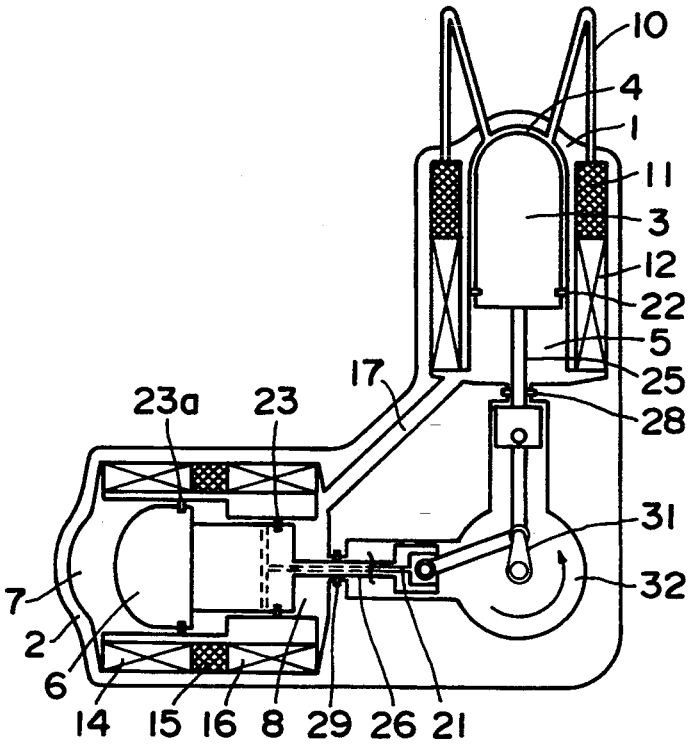
FIG. 18 is another view similar to FIG. 16, showing a further preferred structure of the second embodiment of the hot gas machine according to the invention.

In a further modification shown in FIG. 18, a low temperature chamber 7 of the cylinder 2 is larger than the middle temperature chamber 8 so that the volume of the low temperature chamber 7 is larger than that of the middle temperature chamber 8. In this structure, it is necessary to provide a piston seal 23*a* between the displacer 6 and the side wall of the low temperature chamber 7 in addition to a piston seal 23, and a space formed between the piston seals 23 and 23*a* is connected to a crank chamber 32 or is otherwise open to the outside of the machine. The effective volume of the high temperature chamber 7 is increased compared to that of the low temperature side middle temperature chamber 8.

According to the second embodiment of the invention which has been explained with reference to FIGS. 10 through 18, the gas displacement volume of the low temperature chamber, which is under the same temperature a the low temperature heat source, is larger than the gas displacement volume of the middle temperature chamber which is under the same temperature as the middle temperature heat source. Accordingly, the pressure decreases during the stroke in which heat is absorbed from the high temperature heat source. Consequently, the quantity of heat absorbed increases. Moreover, the gas pressure increases during the stroke in which heat dissipates to the middle temperature heat source whereby the machine exhibits an improved heating capacity.

Third Embodiment

Figure 19:
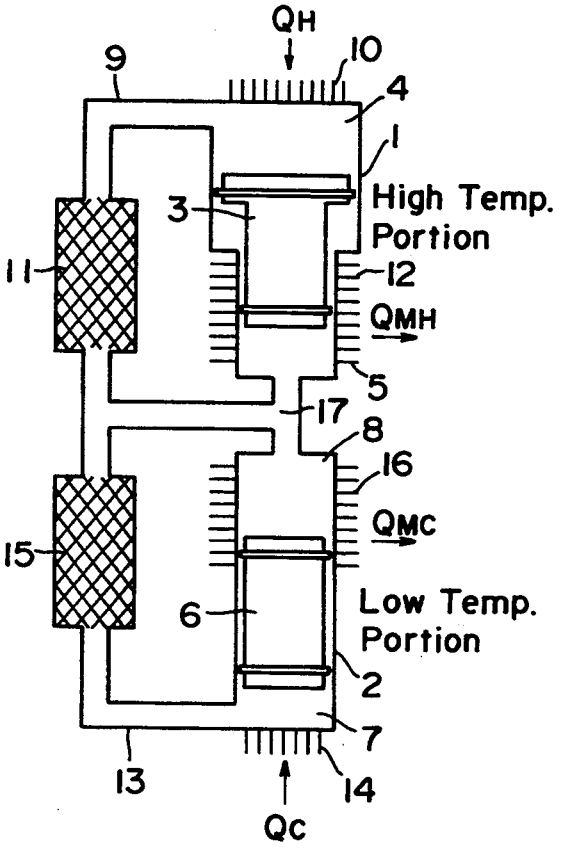
FIG. 19 is a schematic diagram of a third embodiment of a hot gas machine according to the invention.

FIG. 19 shows a third embodiment of a hot gas machine according to the invention. A detailed description of the parts and elements which are quite similar to those of the embodiment shown in FIG. 10 will be omitted.

In the embodiment of FIG. 19, the gas displacement volume of the high temperature chamber 4 is larger than the gas displacement volume of the high temperature side middle temperature chamber 5. FIG. 19 illustrates the high temperature chamber 4 which is provided with an incremental volume. As should be clear, it is not important that the incremental volume vary equally to the variation of the volume of the other portion of the high temperature chamber 4. A suitable mechanism independent of chamber 4 can provide the incremental volume.

The phase difference between the low temperature side displacer 6 and the high temperature side displacer 3 is not limited to 90°, and inner diameters of the cylinders 1, 2 can also be different from each other.

Figure 20:
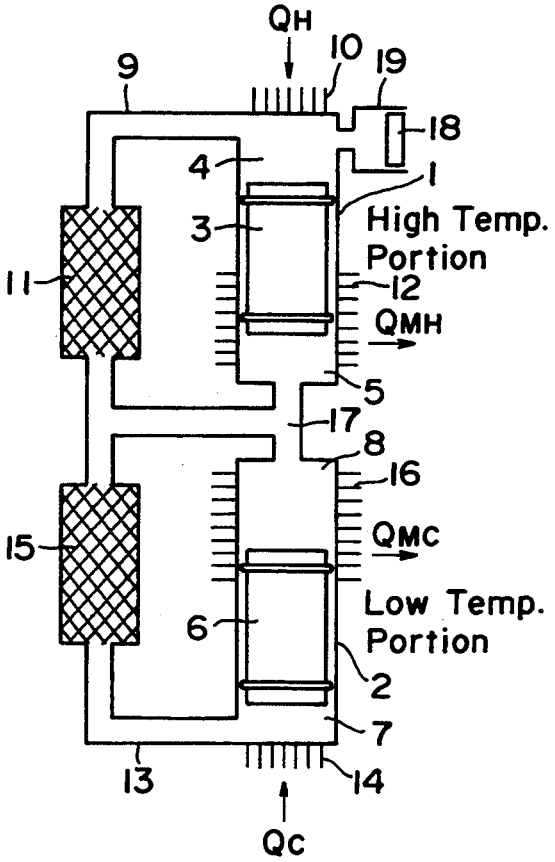
FIG. 20 is another schematic diagram of the third embodiment of a hot gas machine according to the invention.

In a modified structure shown in FIG. 20, a subsidiary cylinder 19 having a piston 18 is connected to a high temperature chamber 4, as a means for incrementing the volume of the high temperature chamber 4, so that the gas displacement volume of the high temperature chamber 4 can be larger than that of the high temperature side middle temperature chamber 5. The incremental volume as well as the phase of the subsidiary cylinder 18 can be selected as desired.

Figure 21:
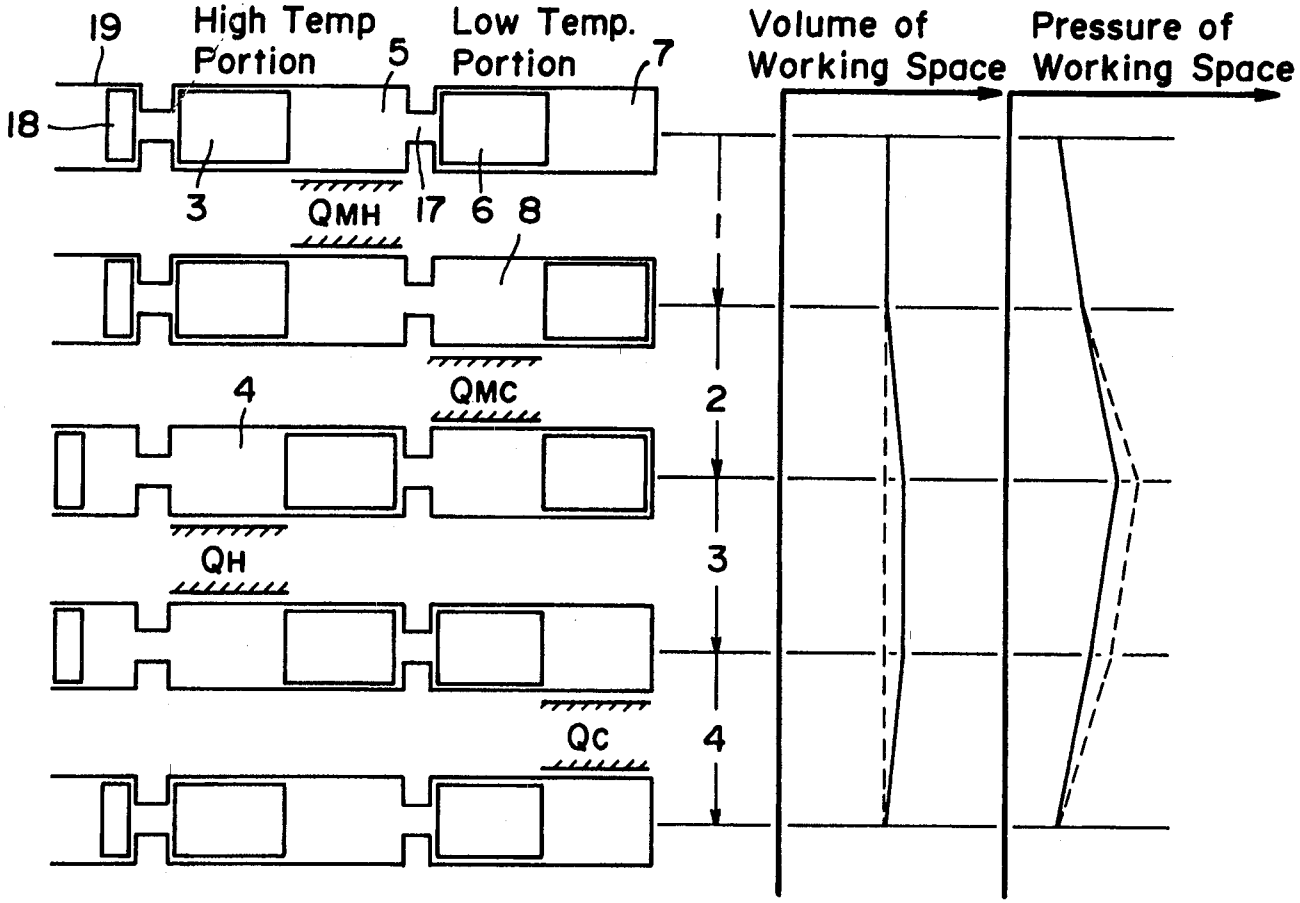
FIG. 21 is an operational diagram of the third embodiment of the hot gas machine, showing strokes during the operation.

FIG. 21 shows operational strokes of the displacers 3, 6 and the piston 18 shown in FIG. 20 and a general variation of the pressure in the working space. As shown, by a displacement (first stroke) of the low temperature side displacer 6, gas in the low temperature chamber is moved to the low temperature side middle temperature chamber 8, so that the pressure in the working space is increased as shown by the solid line.

At this moment, the piston 18 is located at the right end of the subsidiary cylinder 19 in FIG. 21, and the volume of gas in the subsidiary cylinder 19 is zero. Thus, the temperature of gas in the high temperature side middle temperature chamber 5 rises to produce a temperature difference relative to the heat source. Accordingly, a quantity of heat $Q_{MH}$ is dissipated from the middle temperature side heat exchanger 12 of the high temperature portion.

By a displacement (second stroke) of the high temperature side displacer 3, gas is moved to the high temperature chamber 4 from the middle temperature chamber 5, and the pressure is increased as shown by the solid line.

In FIG. 21, the phantom line shows the pressure in the conventional hot gas machine which has no incrementing means such as the piston 18 and cylinder 19 described above. The reason why the pressure shown by the solid line increases to a lesser degree than that shown by the phantom line in FIG. 21 is that gas in the high temperature chamber 5 is incremented by a volume corresponding to that of gas entering the subsidiary cylinder 19. Thus, the quantity of heat $Q_{MC}$ dissipated from the middle temperature side heat exchanger 167 is reduced.

A medium heated by this heat dissipation and a medium heated by the middle temperature side heat exchanger 12 can be used as a heat source.

By a further displacement (third stroke) of the low temperature side displacer 6, gas is moved from the middle temperature chamber 8 to the low temperature chamber 7, so that the pressure in the working space decreases as shown by the solid line.

The reason why the pressure shown by the solid line is lower than that shown by the phantom line is that the piston 18 is maintained at the left end, and gas displaced into the high temperature portion occupies the subsidiary cylinder 19. At this moment a quantity of heat $Q_H$ is absorbed by the high temperature side heat exchanger 10.

By a further displacement (fourth stroke) of the displacer 3, a gas in the high temperature chamber 4 is moved to the middle temperature chamber 5, so that the pressure decreases as shown by the solid line.

The reason why the pressure shown by the solid line decreases to a lesser degree than that shown by the phantom line is that the piston 18 is moved to the right end and the volume of the working gas in the subsidiary cylinder 19 becomes zero. At this moment the temperature of gas in the low temperature chamber 7 decreases, and the quantity of heat $Q_C$ absorbed by the low temperature side heat exchanger 14 decreases. A medium cooled by this heat absorption process can be used in a cooling operation.

As described above, the heat exchange at the high temperature portion is not largely affected by the incremented volume of the high temperature chamber, and the quantity of heat exchanged at the low temperature portion is reduced. However, work at the high temperature portion, that is, a shaft output, is produced.

Figure 22:
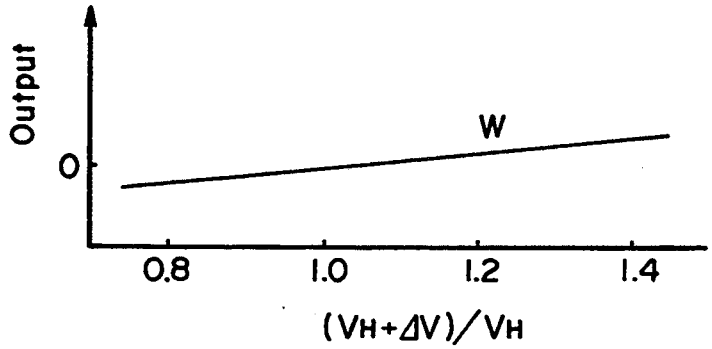
FIG. 22 is a graph of the performance of the third embodiment of the hot gas machine according to the invention.

FIG. 22 shows the machine performance of this embodiment. By in effect increasing the volume $V_H$ of the high temperature chamber 4 with an incremental volume $\Delta V$ so as to have a gas displacement volume greater than that $V_{MH}$ of the middle temperature chamber 5, it can be seen from FIG. 22 that a shaft output W is larger in the range of the inequality $(V_H+\Delta V)/V_H>1$.

Figure 23:
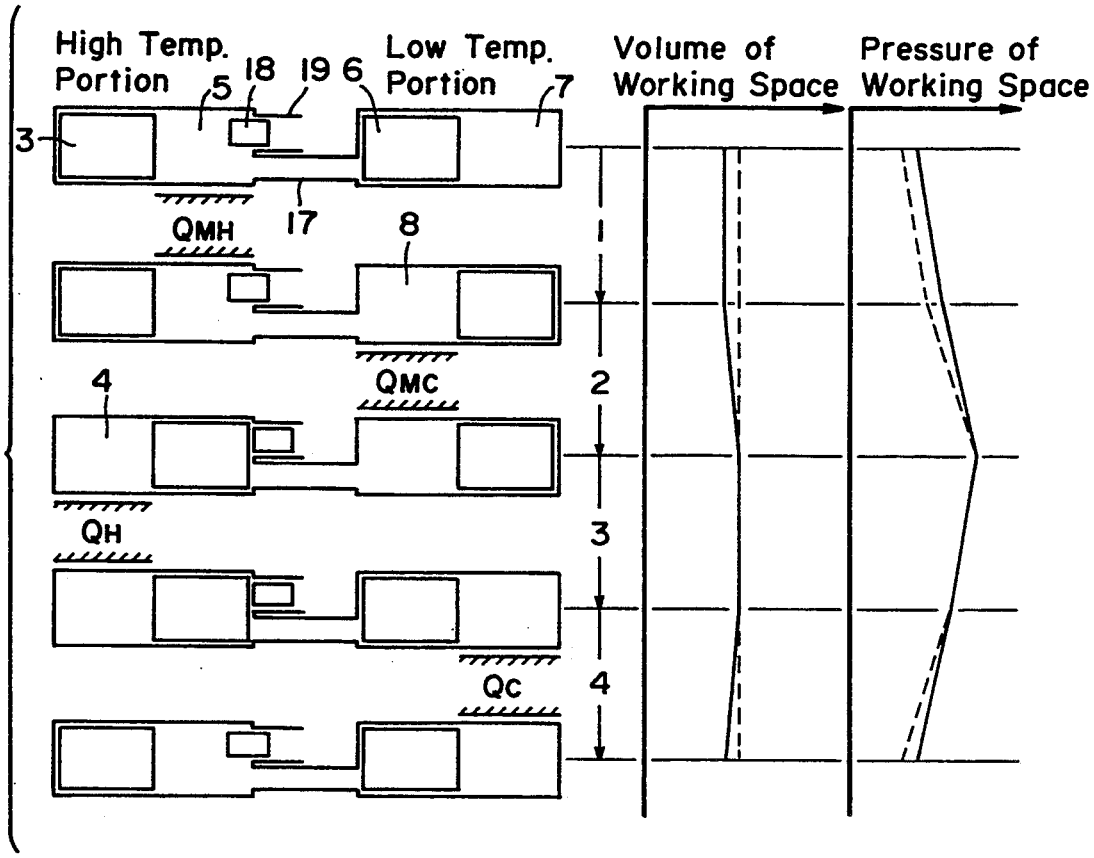
FIG. 23 is an operational diagram of a modification of the third embodiment.

FIG. 23 shows a modification in which a subsidiary cylinder 19 having a piston 18 is provided to in effect reduce the volume of the middle temperature chamber 5 so that the gas displacement volume of the high temperature chamber 4 is larger than that of the middle temperature chamber 5. In this case, a pressure in the working space is increased by a displacement (second stroke) of the displacer 3 as shown by the solid line, so the quantity of heat $Q_{MC}$ dissipated from the middle temperature side heat exchanger 16 is reduced. By a further displacement (fourth stroke) of the displacer 3, the pressure is reduced gently as shown by the solid line, so that a quantity of heat $Q_C$ absorbed by the low temperature side heat exchanger 14 is reduced. However, a shaft output is generated as work produced by the high temperature portion.

Figure 24:
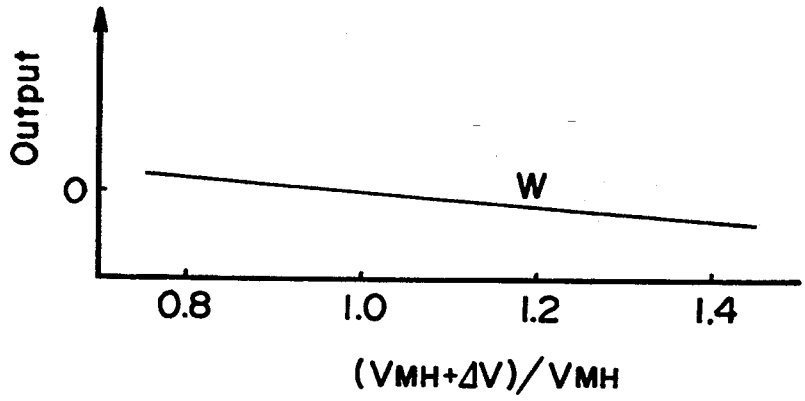
FIG. 24 is a graph of the performance of the modification shown in FIG. 23.

As shown in FIG. 24, similar to FIG. 22, the shaft output W is largest in the range $(V_{MH}+\Delta V)V_{MH}<1$, wherein $V_{MH}$ represents the volume of the high temperature side middle temperature chamber 5.

Figure 25:
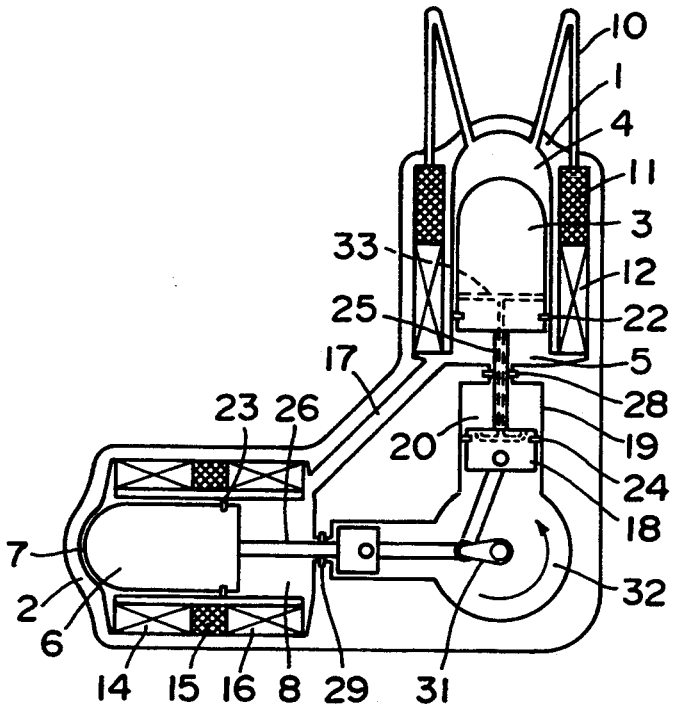
FIG. 25 is a longitudinal elevation view of the third embodiment of the hot gas machine according to the invention.

FIG. 25 shows a detailed structure of the third embodiment shown in FIGS. 19–24. With regard to the parts and elements which are similar to those of FIG. 16, a detailed description is omitted for the sake of simplicity.

In the structure shown in FIG. 25, a subsidiary cylinder 19 and a piston 18 having a common piston rod 25 are provided below a middle temperature chamber 5 in the high temperature side cylinder 1. In order to effectively increase the volume of the high temperature chamber 4, a subsidiary work chamber 20, which is formed above the piston 18 and has the same phase as the displacer 3 is used. Diameters of the piston 18 and the cylinder 19 are suitably determined, and the high temperature chamber 4 is connected to the subsidiary work chamber 20 through a passage 33.

Figure 26:
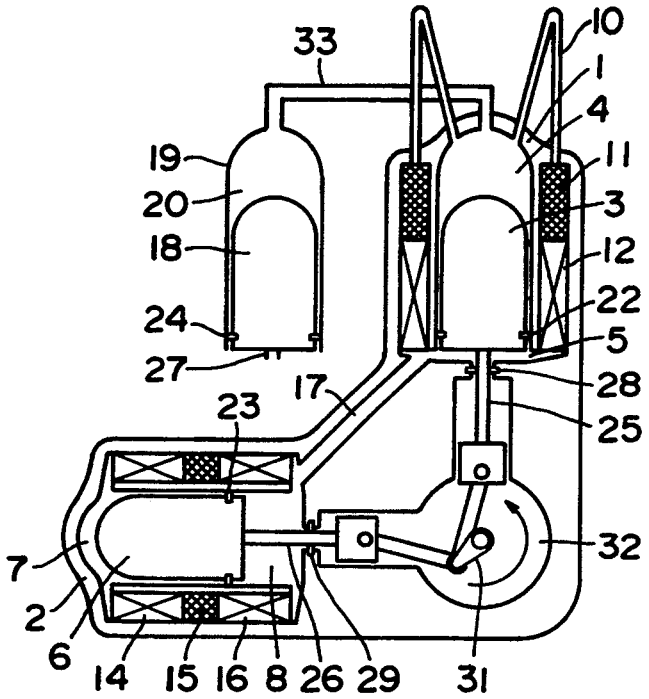
FIG. 26 is a view similar to FIG. 25, showing another preferred structure of the hot gas machine.

FIG. 26 shows a modification, in which the subsidiary cylinder 19 and its piston 18 are provided independently of the cylinders 1 and 2. In this structure, a phase difference of the pistons is determined so as to increment the volume of the high temperature chamber 4.

Figure 27:
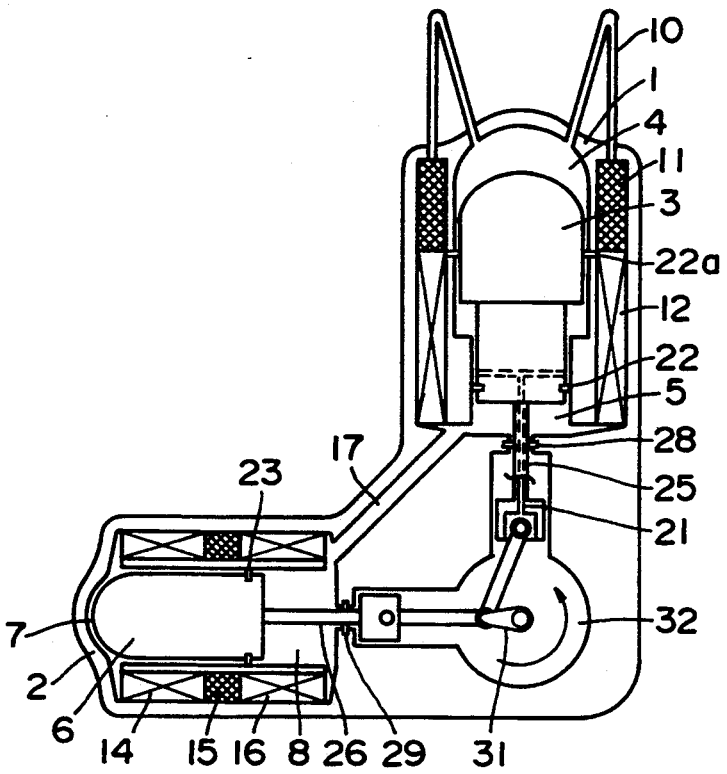
FIG. 27 is a view similar to FIG. 25, showing a further preferred structure of the hot gas machine.

In FIG. 27 showing a further modification, the high temperature chamber 4 has a large diameter so that the gas displacement volume of the high temperature chamber 4 is larger than that of the middle temperature chamber 5. In this structure, a piston seal **22*a* is provided in addition to the piston seal 22, and a space between these seals 22, 22*a* is either connected to a crank chamber 32 or is open to the atmosphere. Further, it is possible to not only increment the volume of the high temperature chamber 4 (by the use of the larger diameter thereof) but to alternatively provide the chamber 4 with a volume smaller than that of the middle temperature chamber 5**.

In the third embodiment of the invention described above, the gas displacement volume of the high temperature chamber is larger than that of the middle temperature chamber which is under the same temperature as the middle temperature heat source. Therefore, the high temperature portion produced a high shaft output.

Fourth Embodiment

Figure 28:
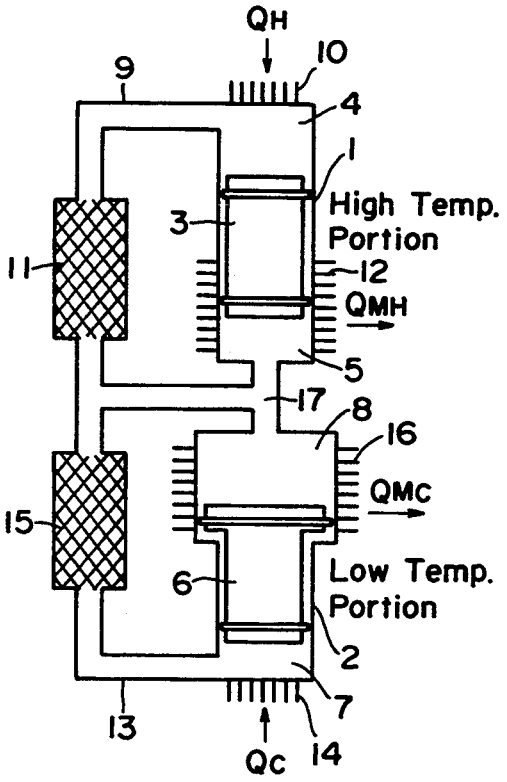
FIG. 28 is a schematic diagram of a fourth embodiment of a hot gas machine according to the invention.

In FIG. 28, which is similar to FIG. 19, a gas displacement volume of the low temperature side middle temperature chamber 8 is larger than the gas displacement volume of the low temperature chamber 7. Although the middle temperature chamber 8 includes the incremental volume, the incremental volume need not vary equally to variations in the other portion of the middle temperature chamber 8, and a suitable mechanism can be provided to increment the volume of the middle chamber 8.

Figure 29:
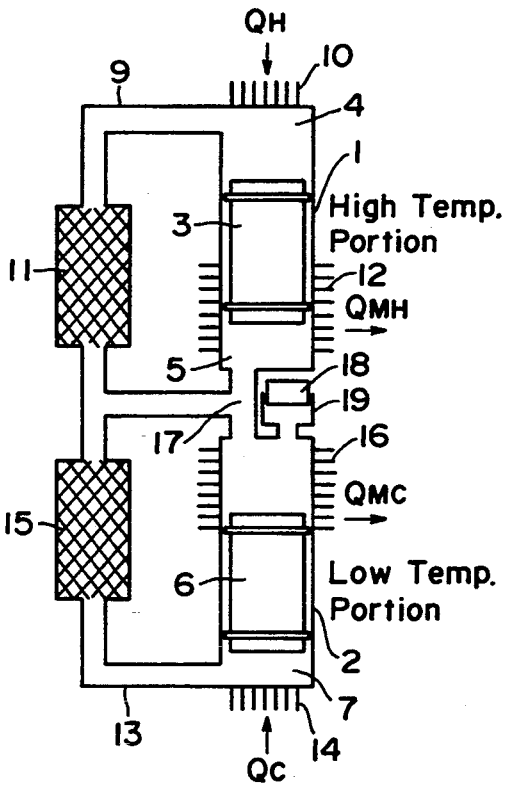
FIG. 29 is another schematic diagram of the fourth embodiment of a hot gas machine according to the invention.

FIG. 29 shows a modification in which a subsidiary piston 18 and a subsidiary cylinder 19 are provided for incrementing the volume of the low temperature side middle temperature chamber 8. The other structural and operational features will be understood from the foregoing description and a detailed description thereof will be omitted.

In the fourth embodiment of the invention described above, although the subsidiary cylinder 19 is connected to the low temperature side middle temperature chamber 8, it can be instead connected to the high temperature side middle temperature chamber 5 which is connected to the low temperature side middle temperature chamber 8.

Figure 30:
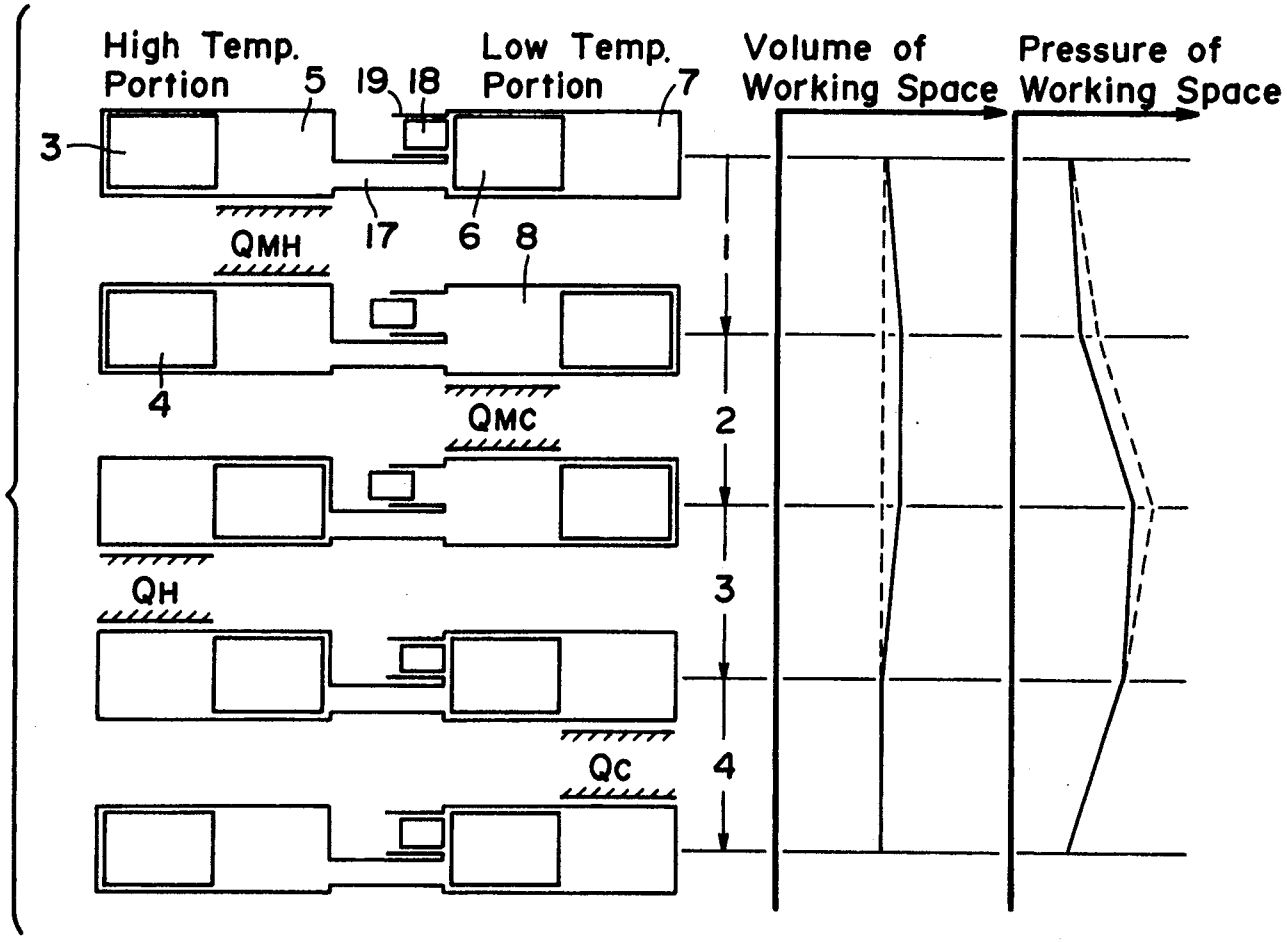
FIG. 30 is an operational diagram of the fourth embodiment of the hot gas machine, showing strokes during the operation.

FIG. 30 shows operational strokes of the displacers 3, 6 and the piston 18, and a pressure variation of the working gas. When gas is displaced (first stroke) from the low temperature chamber 7 to the low temperature side middle temperature chamber 8, the pressure increases as shown by a solid line.

A phantom line shows the pressure obtained by the conventional hot gas machine which has no incrementing means such as the subsidiary cylinder 19. The reason why the pressure shown by the solid line is lower than the pressure shown by the phantom line is that a volume of gas in the low temperature side middle temperature chamber 8 is allowed into the subsidiary cylinder 19. At this moment, the temperature of gas in the middle temperature chamber 5 is raised to produce a temperature difference relative to the heat source. Therefore, a quantity of heat $Q_{MH}$ dissipates from the middle temperature side heat exchanger 12 of the hot temperature portion.

By a displacement (second stroke) of the high temperature side displacer 3, the gas is moved from the middle temperature chamber 5 to the high temperature chamber 4, so that the pressure in the working space is increased.

Since the piston 18 remains at the left end position and the volume of the low temperature side middle temperature chamber 8 is incremented by a volume corresponding to that of gas entering the subsidiary cylinder 19, the pressure increases as shown by the solid line. At this moment, the temperature of gas in the low temperature side middle temperature chamber 8 rises causing a quantity of heat $Q_{MC}$ to dissipate from the middle temperature side heat exchanger 16 of the low temperature portion. The heat $Q_{MC}$ and the aforementioned heat $Q_{MH}$ are used for a heating operation.

By a further displacement (third stroke) of the displacer 6, the gas is moved from the low temperature side middle temperature chamber 8 to the low temperature chamber 7, so that the pressure decreases as shown by the solid line. The reason why the pressure (solid line) decreases to a degree less than that of the pressure shown by the phantom line is that the piston 18 is moved rightward from its left end position and the volume of the subsidiary cylinder 19 varies until it becomes zero. At this moment, the temperature of gas in the high temperature chamber 4 is lowered, and a quantity of heat $Q_H$ which is absorbed by the high temperature side heat exchanger 10 is less than the quantity of heat absorbed in the conventional machine.

By a further displacement (fourth stroke) of the high temperature side displacer 3, the gas is moved from the high temperature chamber 4 to the middle temperature chamber 5, so that the pressure decreases as shown by the solid line. The pressure decrease shown by the solid line is caused by the piston 18 remaining at its extended position such that the volume of gas in the subsidiary cylinder 19 remains zero.

The temperature of gas in the low temperature chamber 7 is thus lowered, and a quantity of heat $Q_C$ is absorbed by the low temperature side heat exchanger 14. A medium cooled by this heat exchanger 14 is used for a cooling operation. During the operation, the quantity of heat absorbed in the low temperature side heat exchanger 10 is constant notwithstanding an incrementing of the volume of the middle temperature chamber 8 and the quantity of heat absorbed in the high temperature side heat exchanger 10. Consequently, the machine exhibits an improved coefficient of performance.

Figure 31:
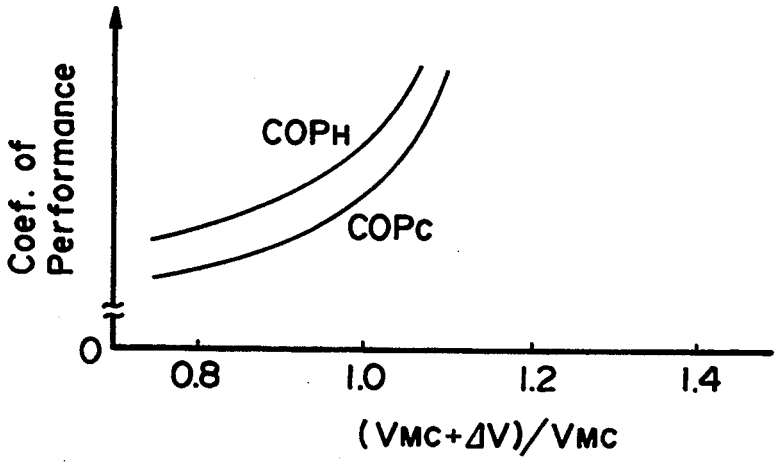
FIG. 31 is a graph of the performance of the fourth embodiment of the hot gas machine according to the invention.

FIG. 31 shows machine performance obtained by increasing the gas displacement volume according to the present invention. A quantity of heat $Q_H$ absorbed in the high temperature side heat exchanger 10 and a quantity of heat $Q_{MH}$ dissipated from the middle temperature side heat exchanger 12 are reduced, but a quantity of $Q_C$ of heat absorbed in the low temperature side heat exchanger 14 and a quantity of heat $Q_{MC}$ absorbed in the middle temperature side heat exchanger 16 of the low temperature portion are substantially constant. Therefore, a coefficient of performance for cooling $COP_C(Q_C \cdot Q_H)$ and a coefficient performance for heating $COP_H[(Q_{MH}+Q_{MC})/Q_H]$ are highest in the range of $(V_{MC}+\Delta V)/V_{MVC}<1$, wherein $V_{MC}$ represents the volume of the low temperature side middle temperature chamber 8, and $\Delta V$ an incremental volume provided by the subsidiary cylinder 19.

Figure 32:
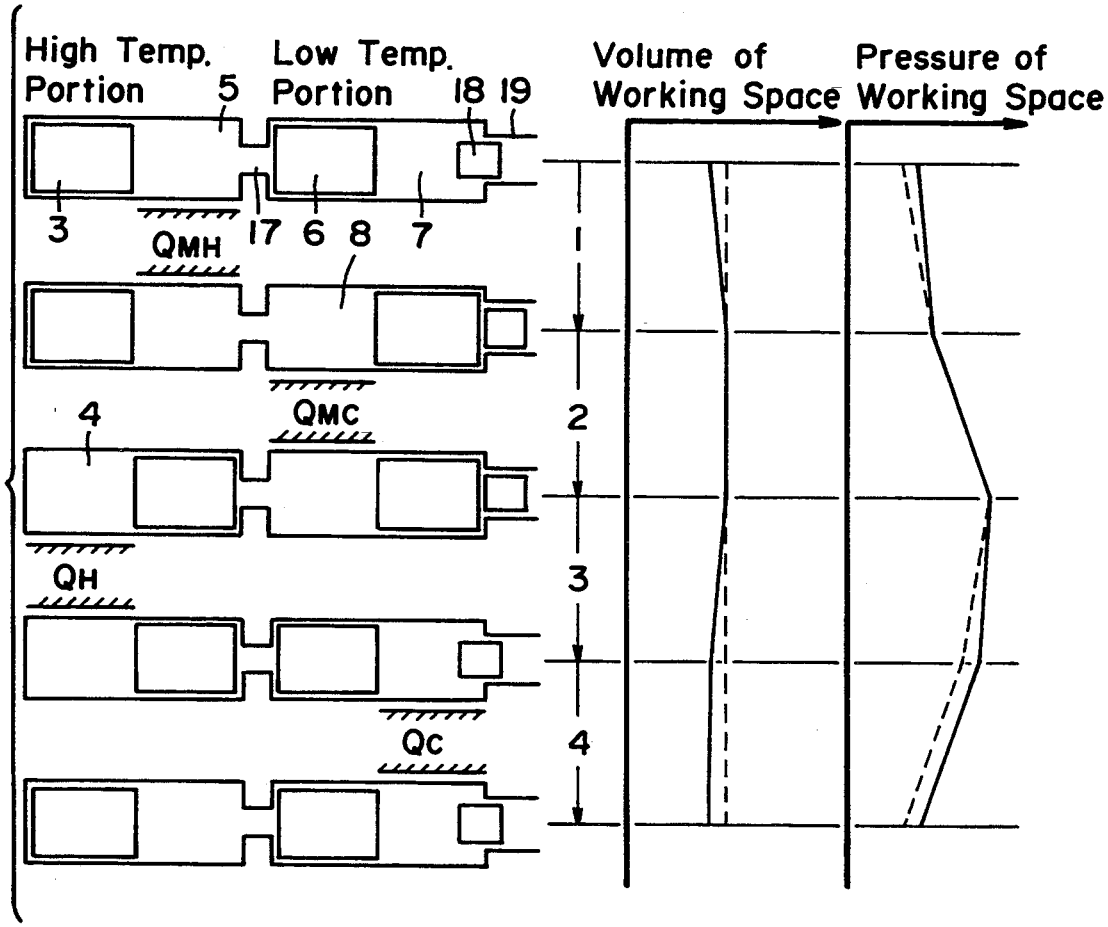
FIG. 32 is an operational diagram of a modification of the fourth embodiment.

FIG. 32 shows a modification in which the subsidiary cylinder 19 is connected to the low temperature chamber 7 to thereby in effect decrease the volume of the low temperature chamber 7, so that the gas displacement volume of the low temperature side middle temperature chamber 8 is larger than that of the low temperature chamber 7. In this case, by a displacement (first stroke) of the low temperature side displacer 6, the pressure in the working space is increased gently so that the quantity of heat $Q_{MH}$ dissipated from the middle temperature side heat exchanger 16 is decreased. By a further displacement (third stroke) of the displacer 6, the pressure is decreased gently as shown by a solid line and the quantity of heat $Q_H$ absorbed by the high temperature side heat exchanger 14 is decreased. However, because a quantity of absorbed heat $Q_C$ and a quantity of dissipated $Q_{MC}$ are substantially constant, the machine has improved coefficients of heating/cooling performance.

Figure 33:
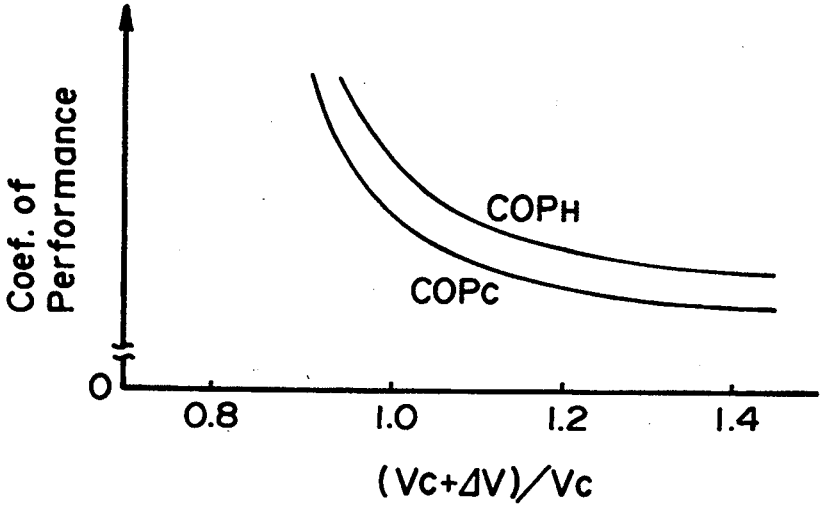
FIG. 33 is a graph of the performance of the modification shown in FIG. 32.

FIG. 33, similar to FIG. 31, shows the machine performance in which the coefficients of performance are greatest in the range of $(V_C+\Delta V)/V_C<1$, wherein $V_C$ represents the volume of the low temperature chamber 7.

Figure 34:
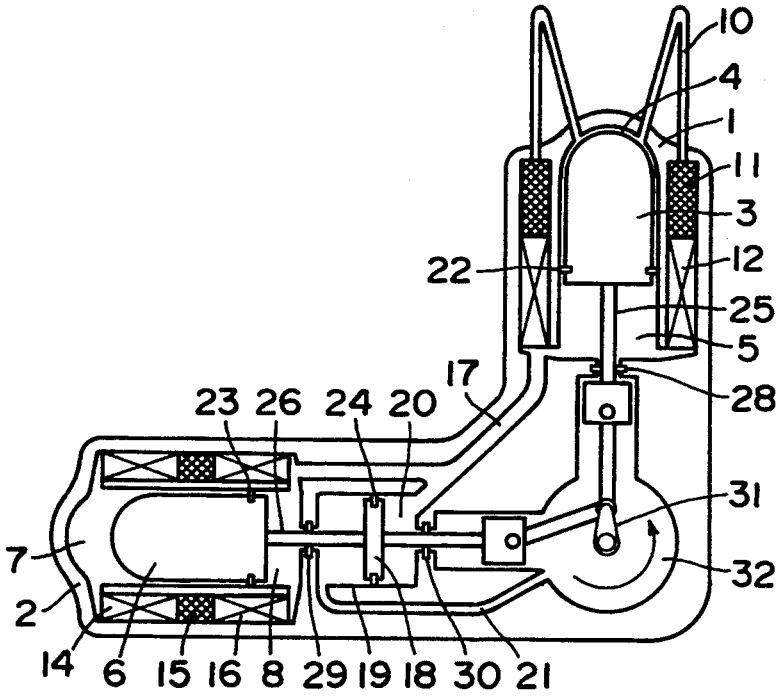
FIG. 34 is a longitudinal elevation view of the fourth embodiment of the hot gas machine according to the invention.

FIG. 34 shows a detailed structure of the fourth embodiment. In this structure, a subsidiary cylinder 19 with a subsidiary piston 18 is disposed between the middle temperature chamber 8 in the cylinder 2 and a crank chamber 32. A subsidiary work chamber 20 is formed to one side of the piston 18 and has a volume that is increased and decreased in phase with increases and decreases in the volume of the low temperature side middle temperature chamber 8. The chamber 20 in effect increases variations in the volume of the low temperature side middle temperature chamber 8. Diameters of these elements 18, 19, 26 are suitably determined, and a space at an upper portion of the piston 18 is either connected to the crank 32 or is open to the atmosphere outside of the machine.

Figure 35:
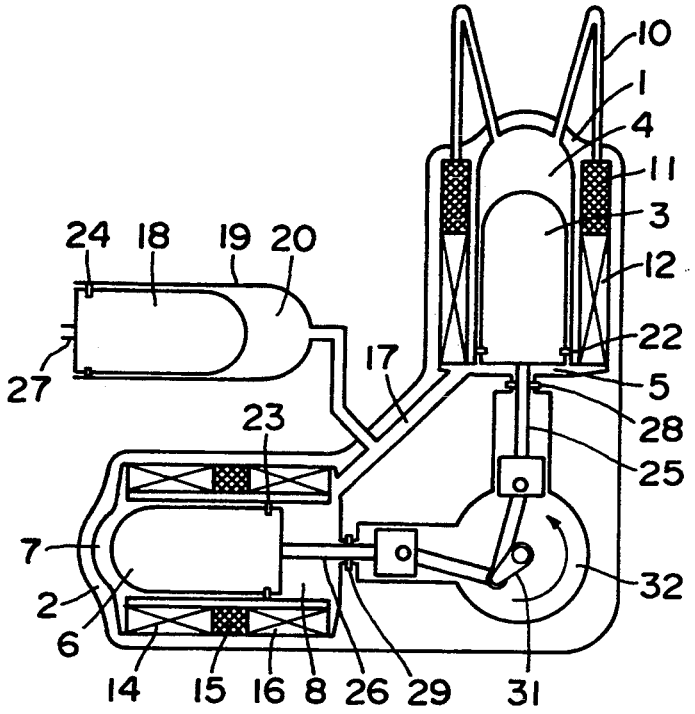
FIG. 35 is a view similar to FIG. 34, showing another preferred structure of the hot gas machine.

In FIG. 35 showing another structure, the subsidiary cylinder 19 and the subsidiary piston 18 are provided independently of the cylinders 1 and 2. The phase of the piston 18 is determined so as to in effect increase variations in the volume of the low temperature side middle temperature chamber 8.

Figure 36:
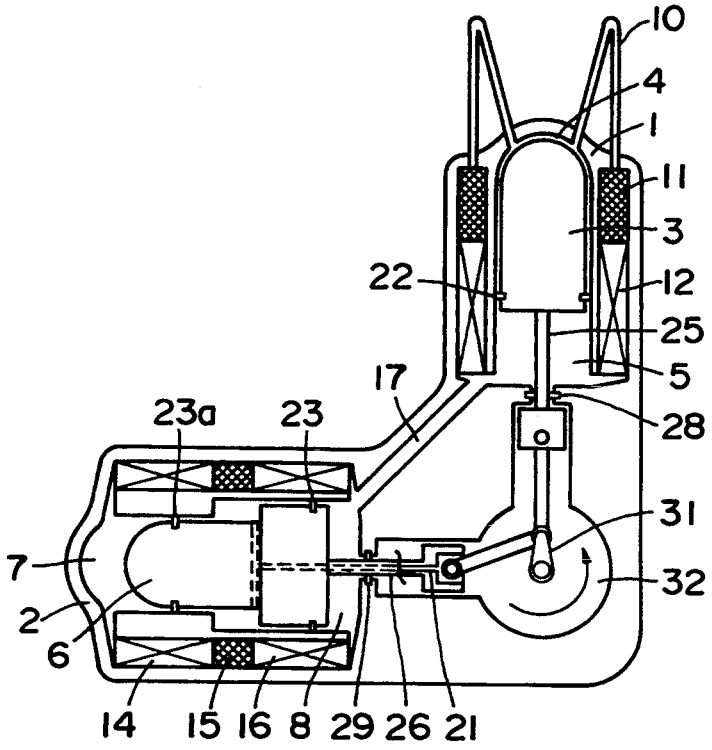
FIG. 36 is a view similar to FIG. 34, showing a further preferred structure of the hot gas machine.

FIG. 36 shows a further structure in which the actual volume of the middle temperature chamber 8 is larger than that of the low temperature chamber 7. An additional piston seal **23*a* is necessary in this structure, and a space between the two piston seals 23, 23*a* is either connected to the crank chamber 32** or is open to the atmosphere.

In the fourth embodiment described with reference to FIGS. 28 to 36, the gas displacement volume of the low temperature side middle chamber is larger than the gas displacement volume of the low temperature chamber under the same temperature as the low temperature side heat source. Accordingly, the pressure of gas during the stroke in which heat is absorbed from the high temperature heat source is decreased to thereby decrease the quantity of absorbed heat absorption, and the degree to which the pressure increases during the stroke in which heat is dissipated to the middle temperature side heat exchanger is reduced. On the other hand, since the quantity of heat absorbed from the low temperature heat source and the quantity of heat dissipated to the middle temperature heat source are substantially constant notwithstanding an effective increase in the gas volume of the middle temperature chamber, the machine exhibits coefficients of heating/cooling performance.

Fifth Embodiment

Figure 37A:
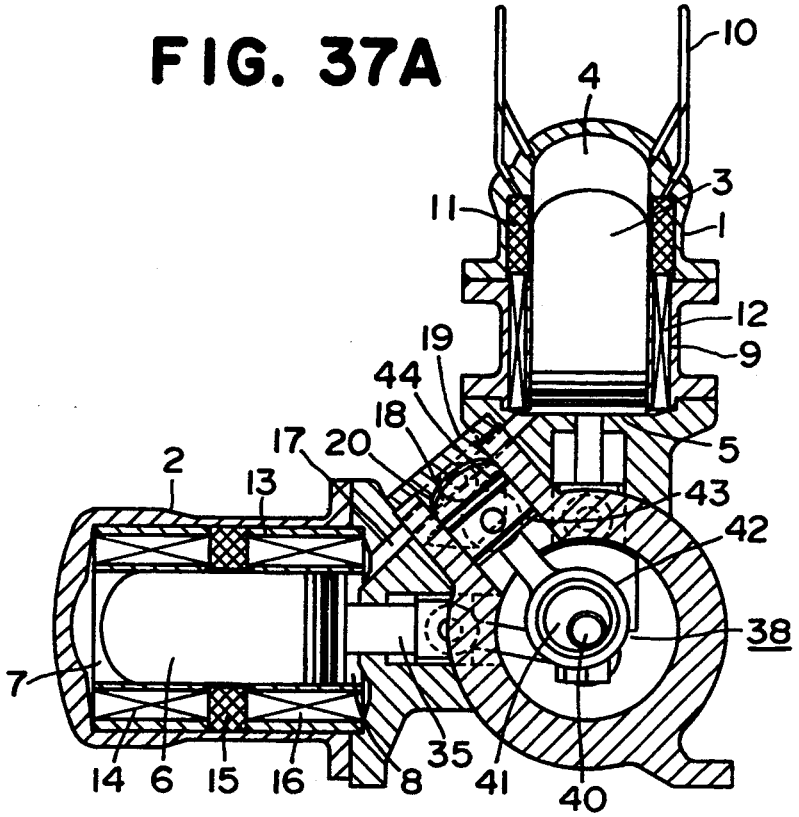
FIGS. 37A and 37B are sectional views of a fifth embodiment of a hot gas machine according to the invention.
Figure 37B:
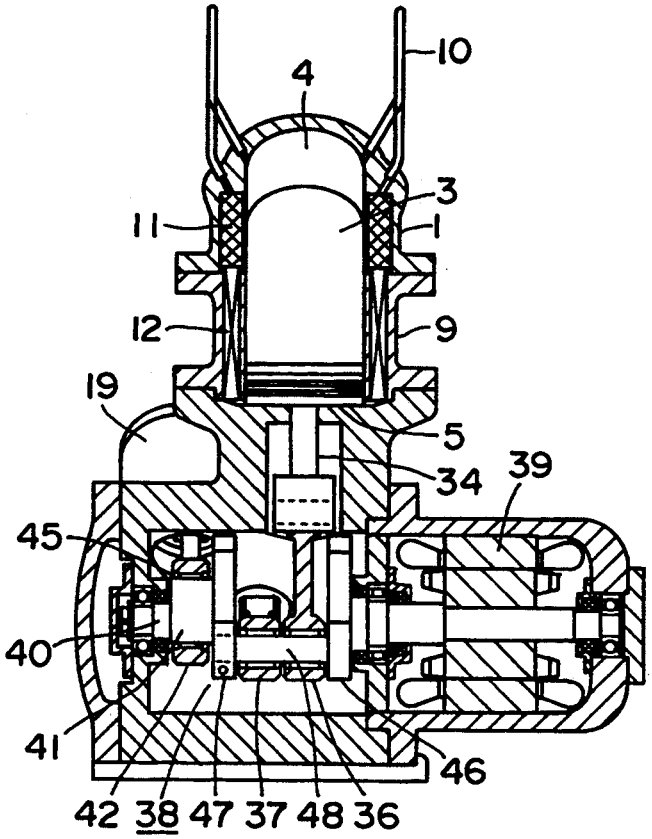

Referring to FIGS. 37A and 37B, a high temperature side cylinder 1 and a low temperature side cylinder 2 have displacers 3 and 6, respectively, to provide a high temperature chamber 4 and a high temperature side middle temperature chamber 5, and a low temperature chamber 7 and a low temperature side middle temperature chamber 8. The displacers 3, 6 are connected to the same crank mechanism 38 through cross-guides 34, 35 and connecting rods 36, 37. A phase angle of the displaces 3, 6 is set to be 90° but the present invention is not limited thereto. The crank mechanism 38 is driven by an electric motor 39.

Figure 38:
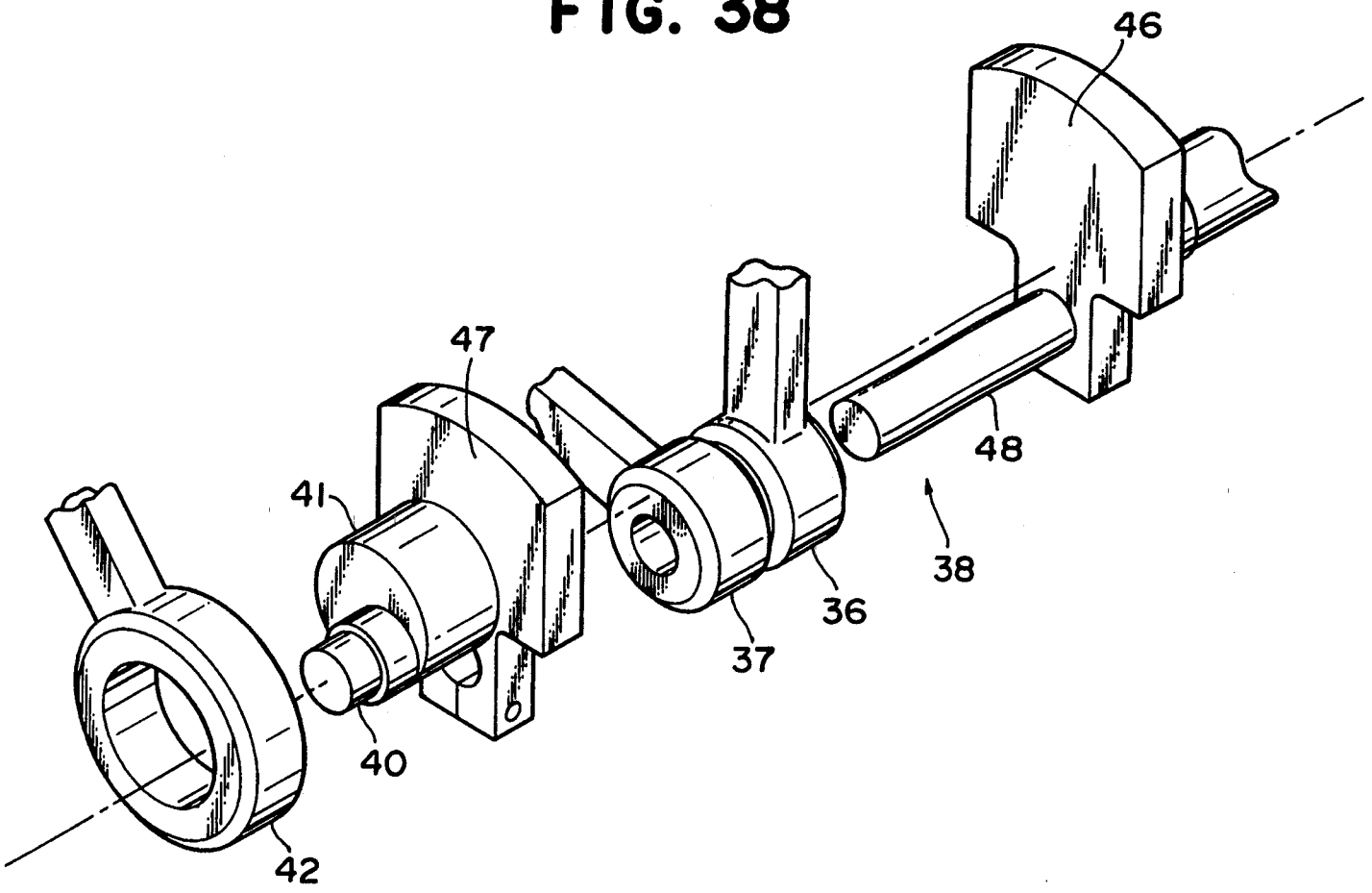
FIG. 38 is a fragmentary perspective view of a crank mechanism used in the fifth embodiment of the hot gas machine according to the invention.

An eccentric shaft 41 is provided on a main shaft 40 of the crank mechanism 38, and a subsidiary piston 18 is connected thereto so that the eccentricity of the eccentric shaft 41 creates the stroke of the piston 18. The subsidiary piston 18 is provided with a connecting rod 42, a rider ring 43 and a piston ring 44. The phase of the subsidiary piston 18 can be selected as desired. A large end of the connecting rod 42 and a bearing 45 for the large end do not need to have a split configuration. Rather, a single portion can couple the piston 18 to the crank mechanism 38. In FIGS. 37A, 37B and 38, reference numerals 46 and 47 designate balance weights and 48 a crank pin.

Figure 39A:
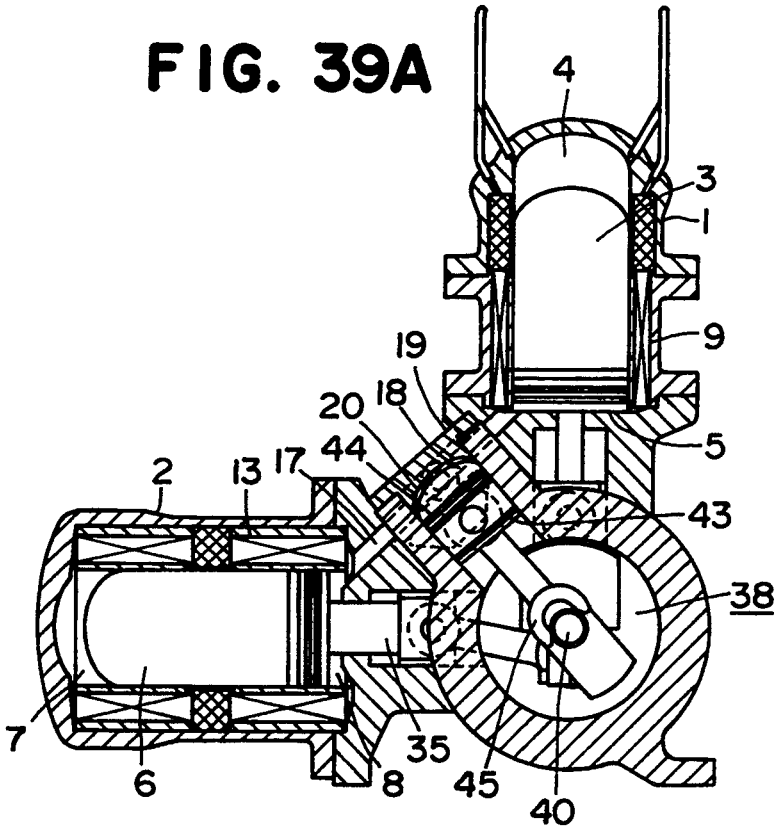
FIGS. 39A and 39B are sectional views of a modification of the fifth embodiment of the hot gas machine.
Figure 39B:
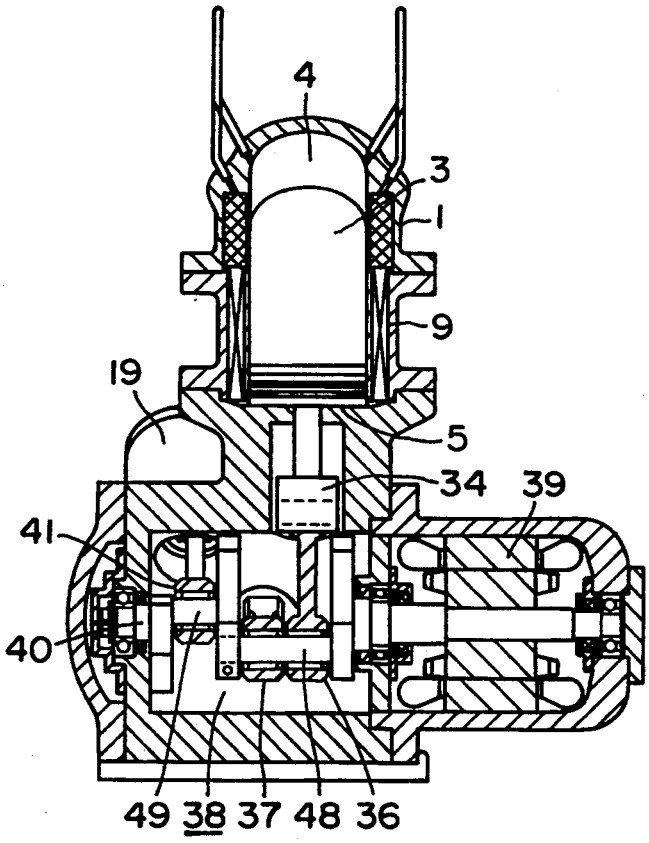

In FIGS. 39A and 39B showing a modification, the crank mechanism 38 has crank pins 48 and 49. The subsidiary piston 18 is coupled to the crank pin 49. The subsidiary piston 18 has a connection rod 41, a rider ring 43 and a piston ring 44 and its phase can be selected as desired. A large end of the connecting rod 41 and a bearing 45 do not need to have a split configuration. Thus, the crank mechanism 38 is provided with two connecting portions.

Figure 40A:
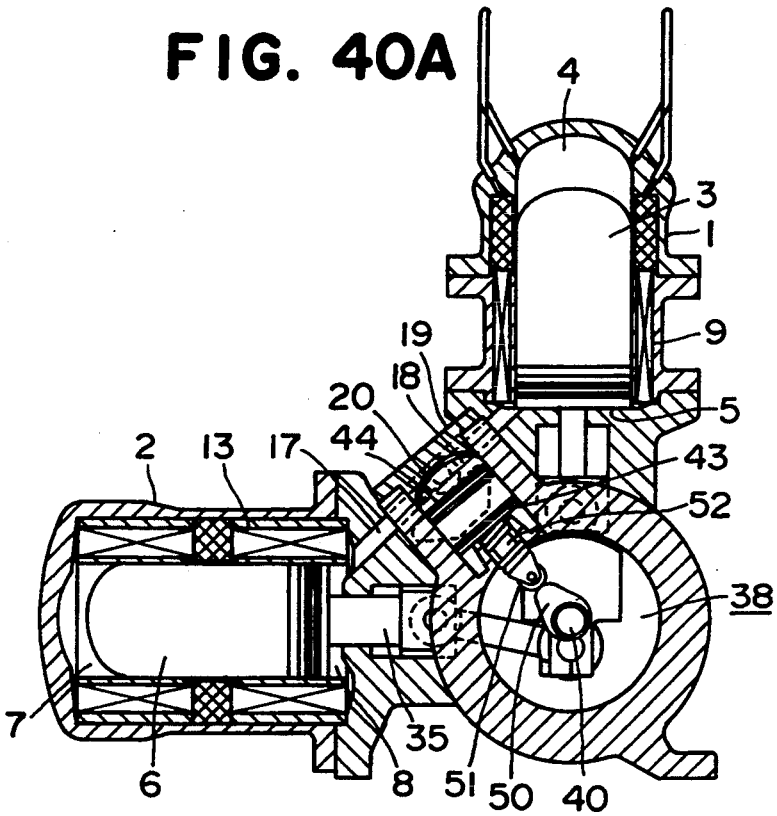
FIGS. 40A and 40B are sectional views of a further modification of the fifth embodiment of the hot gas machine.
Figure 40B:
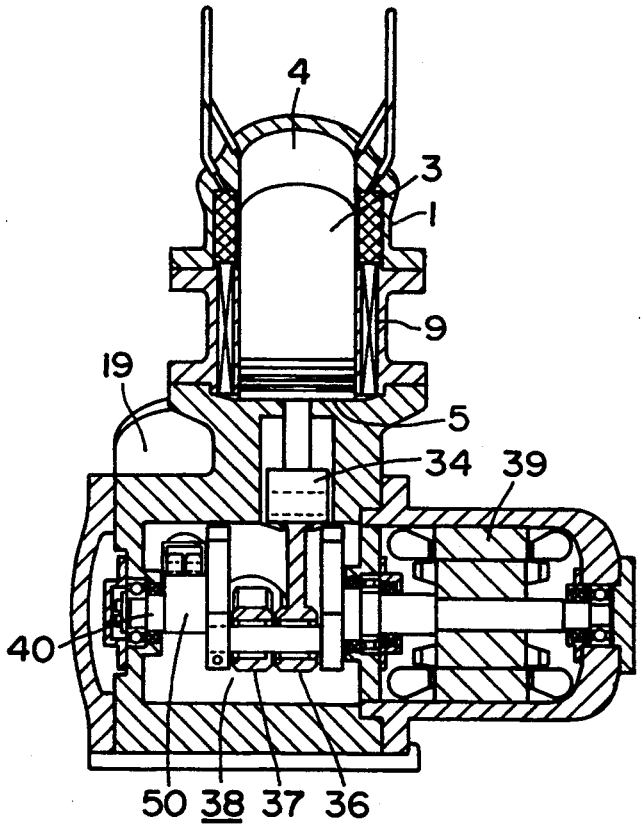

FIGS. 40A and 40B show a further modification of the fifth embodiment of the invention. A cam 50 is provided on the main shaft 40 of the crank mechanism to which the two displaces 3, 6 are connected. The cam 50 is connected to a piston rod 52 having a roller 51, and a subsidiary piston 18 which has a rider ring 43 and a piston ring 44 is connected to the cam 50. A phase of the subsidiary piston 18 can be selected as desired.

In the fifth embodiment, the cam mechanism 38 includes suitable means such as the eccentric shaft 41, additional crank pin 49 or the cam 50, to which the subsidiary piston 18 is connected through the connecting rod 41 or the rod 52 with a roller. Therefore, the subsidiary piston 18 can be driven at a predetermined phase angle, and can be employed in the first to fourth embodiments.

According to the present invention, the gas displacement volume of the high temperature chamber and the gas displacement volume of the middle temperature chamber in the high temperature portion differ, or the gas displacement volume of the low temperature chamber and the gas displacement volume of the middle temperature chamber in the low temperature portion vary so that various characteristics, such as capacities, thermal coefficients, shaft outputs, can be improved by practicing the present invention.

What is claimed is:

1. A thermally activated heat pump comprising:

a high temperature portion and a low temperature portion;

said high temperature portion comprising:

a high temperature cylinder, a high temperature displacer partitioning said high temperature cylinder into a high temperature chamber and a high temperature side middle chamber, said high temperature chamber being defined to one side of said high temperature displacer and said high temperature side middle chamber being defined to the other side of said high temperature displacer, the volume of one of the chambers of said high temperature portion increasing as the volume of the other of the chambers of said high temperature portion decreases during a stroke of said high temperature displacer, a high temperature gas passage connecting said high temperature chamber with said high temperature side middle temperature chamber, and a high temperature side heat exchanger, a high temperature side regenerator and a middle high temperature side heat exchanger, disposed along a circuit formed by said high temperature gas passage;

said lower temperature portion comprising:

a low temperature cylinder, a low temperature displacer partitioning said low temperature cylinder into a low temperature chamber and a low temperature side middle temperature chamber, said low temperature chamber being defined to one side of said low temperature displacer and said low temperature side middle temperature chamber being defined to the other side of said low temperature displacer, the volume of one of the chambers of said low temperature portion increasing as the volume of the other of the chambers of said low temperature portion decreases during a stroke of said low temperature displacer;

a low temperature gas passage connecting said low temperature chamber with said low temperature side middle temperature chamber, and a low temperature side heat exchanger, a low temperature side regenerator and a middle low temperature side exchanger, disposed along a circuit formed by said low temperature cylinder and said low temperature gas passage;

a passage connecting said high temperature side middle temperature chamber to said low temperature side middle temperature chamber; and the middle temperature chamber, in one of said cylinders, having a gas displacement volume larger than that of the other of said chambers in said one of the cylinders.

2. A thermally activated heat pump as claimed in claim 1, wherein said one of the chambers is said low temperature side middle temperature chamber, and said other of the chambers is said low temperature chamber.

3. A thermally activated heat pump as claimed in claim 1, and further comprising a crank mechanism connected to both said high temperature displacer and said low temperature displacer, and wherein said one of the chambers is one of said middle temperature chambers, and a subsidiary cylinder having a subsidiary piston therein is connected to one of said cylinders to create the difference in the gas displacement volumes of the chambers in said one of the cylinders, said subsidiary piston being connected to said crank mechanism.

4. A thermally activated heat pump as claimed in claim 3, wherein said crank mechanism has a crankshaft including a main shaft and a crank, and an eccentric shaft integral with said main shaft and disposed eccentrically with respect to the axis of rotation of said main shaft, said subsidiary piston being coupled to said eccentric shaft.

5. A thermally activated heat pump as claimed in claim 3, wherein said crank mechanism includes a first crank pin coupled to said high temperature and said low temperature displacers, and a second pin coupled to said subsidiary piston.

6. A thermally activated heat pump as claimed in claim 3, wherein said crank mechanism includes a main shaft and a cam integral with said main shaft, and further comprising a rod with a roller integral with said subsidiary piston and coupling said subsidiary piston to the cam of said crank mechanism.

7. A thermally activated heat pump comprising:

a high temperature portion and a low temperature portion;

said high temperature portion comprising:

a high temperature cylinder, a high temperature displacer partitioning said high temperature cylinder into a high temperature chamber and a high temperature side middle chamber, said high temperature chamber being defined to one side of said high temperature displacer and said high temperature side middle chamber being defined to the other side of said high temperature displacer, the volume of one of the chambers of said high temperature portion increasing as the volume of the other of the chambers of said high temperature portion decreases during a stroke of said high temperature displacer, a high temperature gas passage connecting said high temperature chamber with said high temperature side middle temperature chamber, and a high temperature side heat exchanger, a high temperature side regenerator and a middle high temperature side heat exchanger, disposed along a circuit formed by said high temperature gas passage;

said lower temperature portion comprising:

a low temperature cylinder, a low temperature displacer partitioning said low temperature cylinder into a low temperature chamber and a low temperature side middle temperature chamber, said low temperature chamber being defined to one side of said low temperature displacer and said low temperature side middle temperature chamber being defined to the other side of said low temperature displacer, the volume of one of the chambers of said low temperature portion increasing as the volume of the other of the chambers of said low temperature portion decreases during a stroke of said low temperature displacer; and a high temperature side middle chamber having a gas displacement volume larger than that of said high temperature chamber.

8. A thermally activated heat pump comprising:

a high temperature portion and a low temperature portion;

said high temperature portion comprising:

a high temperature cylinder, a high temperature displacer partitioning said high temperature cylinder into a high temperature chamber and a high temperature side middle chamber, said high temperature chamber being defined to one side of said high temperature displacer and said high temperature side middle chamber being defined to the other side of said high temperature displacer, the volume of one of the chambers of said high temperature portion increasing as the volume of the other of the chambers of said high temperature portion decreases during a stroke of said high temperature displacer, a high temperature gas passage connecting said high temperature chamber with said high temperature side middle temperature chamber, and a high temperature side heat exchanger, a high temperature side regenerator and a middle high temperature side heat exchanger, disposed along a circuit formed by said high temperature gas passage;

said lower temperature portion comprising:

a low temperature cylinder, a low temperature displacer partitioning said low temperature cylinder into a low temperature chamber and a low temperature side middle temperature chamber, said low temperature chamber being defined to one side of said low temperature displacer and said low temperature side middle temperature chamber being defined to the other side of said low temperature displacer, the volume of one of the chambers of said low temperature portion increasing as the volume of the other of the chambers of said low temperature portion decreases during a stroke of said low temperature displacer; and incrementing means for establishing a difference in the gas displacement volumes of the chambers in one of said cylinders.

9. A thermally activated heat pump as claimed in claim 8, wherein said incrementing means comprises a subsidiary cylinder and a subsidiary piston in said subsidiary cylinder, said subsidiary cylinder being connected to one of the chambers in said one of the cylinders.

10. A thermally activated heat pump as claimed in claim 8, wherein said incrementing means comprises an inner wall, which defines one of the chambers in said one of said cylinders, having a diameter larger than that of an inner wall defining the other of said chambers in said one of said cylinders, and a head integral with the displacer partitioning said one of said cylinders, said head being located in said one of the chambers in said one of said cylinders and having a diameter larger than that of the displacer partitioning said one of said cylinders.

* * * * *